US005302402A

United States Patent [19]

Dudenhoeffer et al.

[11] Patent Number: 5,302,402

[45] Date of Patent: Apr. 12, 1994

[54] BONE-IN FOOD PACKAGING ARTICLE

[75] Inventors: Vincent J. Dudenhoeffer, Centerville, Iowa; Jeffrey M. Schuetz, Woodridge, Ill.

[73] Assignee: Viskase Corporation, Chicago, Ill.

[21] Appl. No.: 979,520

[22] Filed: Nov. 20, 1992

[51] Int. Cl.[5] ..... B65B 25/00; B65B 31/02; B65D 85/00

[52] U.S. Cl. ..... 426/129; 426/127; 426/412; 426/415; 383/112; 383/113; 383/119

[58] Field of Search ..... 426/127, 129, 106, 410, 426/412, 415, 124; 383/109, 112, 113, 119; 206/497; 156/272.6

[56] References Cited

U.S. PATENT DOCUMENTS

| | | | |
|---|---|---|---|
| 3,741,253 | 6/1973 | Brax et al. | 426/127 |
| 3,983,258 | 9/1976 | Weaver | 426/129 |
| 4,101,711 | 7/1978 | Stillman | 426/127 |
| 4,136,205 | 1/1979 | Quattlebaum | 383/119 |
| 4,178,401 | 12/1979 | Weinberg et al. | 383/109 |
| 4,229,241 | 10/1980 | Mueller | 426/127 |
| 4,239,111 | 12/1980 | Conant et al. | 426/124 |
| 4,267,960 | 5/1981 | Lind et al. | 383/119 |
| 4,411,919 | 10/1983 | Thompson . | |
| 4,534,984 | 8/1985 | Kuehne . | |
| 4,704,101 | 11/1987 | Schirmer | 383/119 |
| 4,755,403 | 7/1988 | Ferguson . | |
| 4,764,028 | 8/1988 | Wood et al. . | |
| 4,765,857 | 8/1988 | Ferguson | 426/127 |
| 4,770,731 | 9/1988 | Ferguson | 426/127 |
| 4,863,769 | 9/1989 | Lustig et al. . | |
| 5,020,922 | 6/1991 | Schirmer . | |

*Primary Examiner*—Michael W. Ball
*Assistant Examiner*—R. Robey
*Attorney, Agent, or Firm*—John C. LeFever

[57] ABSTRACT

An article for shrink packaging bone-in food masses such as meat cuts comprising a thin-walled heat shrinkable thermoplastic film bag and a thick-walled nonheat shrinkable thermoplastic film patch having its inner surface bonded to the bag outer surface. Both surfaces have high energy as the sole bonding means and the patch-bag bond strength increases during heat shrinking around the meat mass such that the bag portion adhered to the patch shrinks less than the rest of the bag.

19 Claims, 3 Drawing Sheets

BONE-IN FOOD PACKAGING ARTICLE

This invention relates to the packaging of bone-in food masses such as cuts of meat. In particular, the invention relates to an article comprising a thermoplastic evacuable heat shrinkable bag - external patch combination, a method for packaging bone-in food mass, and a transportable evacuated sealed package containing bone-in food mass.

BACKGROUND OF THE INVENTION

The use of heat shrinkable thermoplastic film as flexible packaging material for vacuum packaging perishable food mass is well-known. This type of film is relatively thin, e.g. less than 4 mils, so itself is not suitable for packaging bone-in food mass such as meat. For example, attempts to use such thin film in bag form to package bone-in sub-primal rib beef cuts are generally unsuccessful because the bone punctures the film. The puncture problem is compounded by external abrasion between adjacent packages when they are transported in containers subject to intransit vibration and movement during loading and unloading.

To alleviate this problem the most common practice was to use cushioning materials such as paper, paper laminates, wax impregnated cloth, foam and various types of plastic inserts inside the bag over the bone-in section, as for example described in Selby et al. U.S. Pat. No. 2,891,870. This approach was only a partial solution because the inserts tend to slide during usage and are labor-intensive.

Another approach was to adhere a puncture guard in the form of a patch on the outer surface of the heat shrinkable bag. One form of patch was a plurality of oriented sheets which are laminated in cross-oriented relationship, as for example described in Conant U.S. Pat. No. 4,239,111. However, in actual use the manufacturer reported that the non-heat shrinkable patch, which was adhesively bonded to the bag outer surface, tended to delaminate when the evacuated bag was heat shrunk around and onto the bone-in food mass outer surface. Another complication with cross oriented patches, such as those formed of high density polyethylene manufactured from material obtained from Van Leer Plastics B.V., under the trademark VALERON®, is that the material is relatively stiff and does not readily conform to the contours of a bone-in food mass containing bag. According to Kuehne U.S. Pat. No. 4,534,984 this problem may be overcome by the additional process steps of forming longitudinal lines of weakness as for example by slitting or serrating, then folding the patch along these lines.

To overcome these problems, Ferguson U.S. Pat. No. 4,755,403 describes a patch bag combination wherein a particular type of heat shrinkable patch is bonded by adhesive to the outer surface of the heat shrinkable bag. The shrink properties of the bag and patch are matched so that on heating, the patch shrinks with the bag and thereby reduces the tendency of the patch to delaminate from the bag. Because the patch is relatively thick, for example 5 mils, it is most conveniently manufactured as a multilayered tube with self adhering inner surfaces. Accordingly, when the tube is collapsed on itself the inside surfaces of the inner layers "block" or adhere to each other and a relatively thick heat shrinkable patch is formed.

More specifically, the aforementioned U.S. Pat. No. 4,755,403 describes a patch formed from a tube comprising an outer layer of 87% linear low density polyethylene (LLDPE), 10% ethylene vinyl acetate (EVA) having 9% vinyl acetate (VA) content, and an inner layer comprising EVA with 28% VA content. Because the inner layer must be self adhering, the tube must be extruded with powder such as starch particles on the inner layer inside surface to prevent adhesion during extrusion. This is necessary because the primary tube must be reinflated to form the trapped or secondary bubble if the tube is to be biaxially oriented by this method. When the resulting oriented tube is collapsed, the starch particles are sufficiently spread apart by the two way stretching and thinning of the film, that the collapsed tube becomes self adhering.

Patent '403 also teaches that irradiative cross linking of the patch is necessary to strengthen the tube sufficiently to permit inflation as a bubble for biaxial orientation. Accordingly, the irradiation step must be performed on the relatively thick primary tube, and relatively high power is needed for this because of the thick-walled tube.

It will be apparent from the foregoing that the patch bag of Patent '403 is relatively expensive to manufacture because of the need to use high VA content EVA (for self adhesion), the need for multiple layers, the need for powdered starch as an antiblock, the high power consumption resulting from irradiation of a relatively thick patch, and the need for biaxial orientation. Moreover, the manufacturing process requires adhesive application to either or both the patch inner surface and the bag outer surface, careful placement of the patch on the bag or rollstock surface for proper mating of adhesive-coated surfaces, pressure contact and elevated temperature curing of the adhesive bond.

There are also inherent functional limitations on the heat shrinkable patch-bag combination. Since the patch biaxially shrinks to about the same extent as the substrate bag, a substantial proportion of the as-applied patch surface area does not perform the guard function when heat shrunk. This means that whereas a protruding bone area of food mass may have been covered by an overlying patch when placed in the bag, when the patch-bag combination is heat shrunk around the food mass a significant portion of the bone area on the perimeter of the non-shrunk patch may be no longer covered by the non-shrunk patch. For example, if the original patch is square and 10 inches on each side and the shrink is 25% in both directions, the cross-sectional area of the heat shrunk patch is only about 56% of the original surface.

The prior art has taught that for some applications, thermoplastic surfaces may be made self adhering by exposing the surfaces to corona treatment and then pressure contacting the surfaces. For example, Shirmer U.S. Pat. No. 4,605,460 discloses a high barrier shrink film wherein the EVA surfaces of a hot blown melt oriented high oxygen barrier film and a stretch oriented base film are each corona treated and then contacted between nip rolls for lamination. However, to the best of applicants' knowledge corona treatment has not been used in patch bag construction to bond the patch and the bag, probably because of the high abrasion/delamination forces experienced by the patch in commercial use.

One object of this invention is to provide an improved patch bag article for enclosing bone-in food products.

A specific object is to provide an improved patch bag article wherein the patch need not be irradiated to perform its intended function.

Another object is to provide an improved patch bag article comprising a non-heat shrinkable patch which does not delaminate from the evacuated bag when the latter is heat shrunk around bone-in food mass.

A further object is to provide an improved patch bag article comprising a non-heat shrinkable patch, heat shrinkable bag article which does not require an adhesive therebetween, yet with a patch-bag bond so strong that substantially no delamination of the patch occurs when the evacuated bag is heat shrunk.

Still another object is to provide an improved food package comprising a heat shrunk, evacuated and sealed bag containing bone-in food mass and a non-delaminated non-heat shrinkable patch bonded to the bag outer surface without a separate adhesive.

A still further object is to provide an improved method for packaging bone-in food mass in an adhesive-free heat shrinkable bag - non-heat shrinkable patch article by evacuating and sealing the food mass - containing article, and heat shrinking the package without delamination of the patch.

SUMMARY OF THE INVENTION

In one aspect the invention relates to an article for enclosing bone-in food mass comprising a biaxially heat shrinkable relatively thin-walled thermoplastic film bag and at least one non-heat shrinkable relatively thick-walled thermoplastic film patch bonded to an outer surface of the bag. The patch outer surface comprises a member selected from the group consisting of ethylene vinyl acetate (EVA), very low density polyethylene (VLDPE) and linear low density polyethylene (LLDPE), or blends thereof. That is, the patch outer layer may be blends of EVA-VLDPE, EVA-LLDPE, EVA-VLDPE-LLDPE, or VLDPE-LLDPE. The patch inner surface comprises a member selected from the group consisting of EVA, VLDPE, and blends of EVA and VLDPE. The bag outer surface comprises a member selected from the group consisting of EVA, VLDPE, blends of EVA and VLDPE, blends of EVA and LLDPE, and blends of EVA, VLDPE and LLDPE. The patch inner surface and the bag outer surface each have high surface energy (measured as wetting tension) of at least about 38 dynes/cm as the sole bonding means therebetween, such that when the bag is filled with the bone-in food product, evacuated, sealed and heat shrunk against the food mass, the strength of the patch-bag bond increases and the bag portion adhered to the patch shrinks to a lesser extent than the remainder of the bag, but the patch does not delaminate from the bag outer surface. As used herein, "sole bonding means" means that a separate adhesive is not needed to bond the bag outer surface and patch inner surface. This for example may be accomplished by first contacting the two high energy surfaces in flat form under pressure to form an initial bond and thereafter passing the bone-in food mass containing patch bag through a hot tunnel to heat shrink the bag and increase the patch-bag bond strength.

Another aspect of the invention relates to a food package comprising a heat shrunk and relatively thin-walled thermoplastic film bag containing bone-in food mass in an evacuated and sealed space within the bag. The bone-in food mass outer surface is in direct supporting relationship to the heat shrunk bag inside surface. A non-heat shrinkable and relatively thick-walled thermoplastic film patch is provided, and the patch inner surface and the collapsed heat shrink bag outer surface are in direct contact. The patch outer surface comprises a member selected from the group consisting of EVA, VLDPE and LLDPE, or blends thereof. The patch inner surface comprises a member selected from the group consisting of EVA, VLDPE, and blends of EVA and VLDPE. The bag outer surface comprises a member selected from the group consisting of EVA, VLDPE, blends of EVA and VLDPE, blends of EVA and LLDPE, and blends of EVA, VLDPE and LLDPE. These two surfaces each have high wetting tension of at least about 38 dynes/cm$^2$ as the sole bonding means therebetween prior to introduction of the bone-in food mass. The strength of this patch-bag bond increases during the heat shrinking, and the bond is of sufficient strength that the bag portion adhered to the patch shrinks to a lesser extent than the remainder of the bag, but the patch does not delaminate from the bag outer surface when the bag is heat shrunk.

A further aspect of the invention is a method for packaging bone-in food mass and comprises several steps including providing a heat shrinkable relatively thin-walled thermoplastic film and a non-heat shrinkable relatively thick-walled thermoplastic film patch. An outer surface of the patch comprises a member selected from the group consisting of EVA, VLDPE and LLDPE, or blends thereof. The patch inner surface comprises a member selected from the group consisting of EVA, VLDPE, and blends of EVA and VLDPE. At least an outer surface of the thin-walled film comprises a member selected from the group consisting of EVA, VLDPE, blends of EVA and VLDPE, blends of EVA and LLDPE, and blends of EVA, VLDPE and LLDPE. The film outer surface and the patch inner surface are separately exposed to high energy to impart wetting tension of at least about 38 dynes/cm, and the two high energy surfaces are contacted under pressure as a first bonding step with the high energy surfaces as the sole bonding means to form an initially bonded patch-film substrate article. This article is then converted into a patch bag with the patch inner surface bonded to the bag outer surface.

Next, the bone-in food mass is charged into the patch bag and the food mass containing patch bag is evacuated and sealed so that the bone-in food mass outer surface is in direct supporting relationship to the collapsed bag inside surface. The bag is heat shrunk against the bone-in food mass outer surface and the bag-patch high surface energy bond strength is simultaneously increased as a second patch-bag bond enhancement step so the bond is sufficient to prevent delamination of the non-heat shrinkable patch from the heat shrunk bag. During the heat shrinking step the bag portion adhered to the patch shrinks to a lesser extent than the remainder of the bag.

Although the inner and outer surfaces of the inventive patch have different requirements as previously defined, they may both be satisfied by certain types of single component material or a monolayer blend film. Alternatively, the patch may be multilayer with the inner and outer surfaces formed of different materials.

As hereinafter described in detail, the present invention accomplishes all of the aforedescribed objectives, and in one aspect comprises a patch bag which is at least functionally equivalent to present commercially employed patch bags, but includes a patch which does not require the expensive features of biaxial orientation, irradiative cross-linking or adhesion material for lamination of the patch inner surface to the bag outer surface.

BRIEF DESCRIPTION OF THE DRAWINGS

Further details are given below with reference to the drawings wherein.

DESCRIPTION OF THE PREFERRED EMBODIMENT

Figure 2:
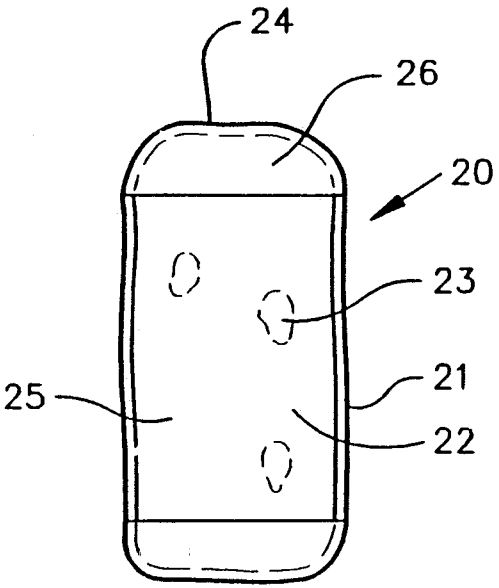

As previously explained, the thin-walled thermoplastic film forming the bag is "biaxially heat shrinkable". As used herein this means that the film has an unrestrained shrinkage of at least ten (10) percent in each of the transverse and machine directions measured at 90° C. (194° F.). Preferably, the film has an unrestrained shrinkage of at least twenty (20) percent in each direction. Likewise, the relatively thick-walled thermoplastic film patch is "non-heat shrinkable". As used herein this means the patch has an unrestrained shrinkage below about five (5) percent in each of the transverse and machine directions measured at 90° C.

For purposes of measuring the shrink value of a thermoplastic film and comparing it with these definitions, the unrestrained shrink of the film is measured by a procedure derived from ASTM D2732 after immersion in a water bath at 90° C. for five seconds. Four test specimens are cut from a given sample of the film to be tested. The specimens are cut to 10 cm. in the machine direction by 10 cm. in the transverse direction. Each specimen is completely immersed for 5 seconds in a 90° C. water bath. After removal from the water bath the distance between the ends of the specimen is measured. The difference in the measured distance for the shrunken specimen and the original 10 cm. is multiplied by ten to obtain the percent of shrinkage for the specimen. The shrinkage for the four specimens is averaged for the MD shrinkage values of the given film sample, and the shrinkage for the four specimens is averaged for the TD shrinkage value.

The terms "barrier" or "barrier layer" as used herein in connection with the bag means a layer of a multilayer film which acts as a physical barrier to gaseous oxygen molecules. Physically, a barrier layer material will reduce the oxygen permeability of a film (used to form the bag) to less than 70 cc per square meter in 24 hours at one atmosphere 73° F. (23° C.) and 0% relative humidity. These values should be measured in accordance with ASTM standard D-1434.

The expression "ethylene vinyl acetate copolymer" (EVA) as used herein refers to a copolymer formed from ethylene and vinyl acetate monomers wherein the ethylene derived units (monomer units) in the copolymer are present in major, by weight, amounts and the vinyl acetate derived units (monomer units) in the copolymer are present in minor, by weight, amounts, generally between about 5 and 40 wt. % of the total.

The expression "wetting tension" refers to a measure of the surface energy of a film in accordance with the test described in ASTM D2578-84. An essential aspect of this invention is that the patch inner surface and the bag film outer surface to be bonded together are each separately exposed to high energy to impart wetting tension of at least about 38 dynes/cm to these surfaces. This may for example be accomplished by corona discharge, flame, plasma and ultraviolet treatment, and, in general, treatments which expose the EVA-polyethylene blend surfaces to energetic radiation in the presence of gas such as oxygen or nitrogen. Corona discharge is the preferred high energy to film surface transfer method, and preferably in the range of about 44 to 46 dynes/cm wetting tension. Higher surface energies do not appear necessary to achieve the needed strong bond between the patch and the bag.

Of general interest concerning adhering surface treatment of polymeric materials is the representative disclosure of Bonet U.S. Pat. No. 4,120,716 directed to improvement of adherence characteristics of the surface of polyethylene by corona treatment to oxidize the polyethylene surface to promote wetting by printing inks and adhesives. Of general interest concerning flame surface treatment of polymeric film is the representative disclosure of Lonkowsky U.S. Pat. No. 2,767,103. Of general interest concerning ultra violet surface treatment of polymeric film is the representative disclosure of Wolinski U.S. Pat. No. 3,227,605. Of general interest concerning plasma surface treatment of polymeric film is the disclosure of Baird et al. U.S. Pat. No. 3,870,610.

The expression very low density polyethylene ("VLDPE") sometimes called ultra low density polyethylene ("ULDPE"), refers to linear and non-plastomeric polyethylenes having densities below about 0.914 g/cm$^3$ and according to at least one manufacturer, possibly as low as 0.86 g/cm$^3$. This expression does not include ethylene alpha olefin copolymers of densities below about 0.90 g with elastomeric properties and referred to by at least one manufacturer as "ethylene alpha olefin plastomers". However, as hereinafter explained, ethylene alpha olefin plastomers may be used in the practice of this invention as a minor constituent in the patch inner or outer surface and/or the bag outer surface, as long as it does not prevent the surface from performing its intended function. VLDPE does not include linear low density polyethylene (LLDPE) which have densities in the range of about 0.915–0.930 gm/cm$^3$.

VLDPE comprises copolymers (including terpolymers) of ethylene with alpha-olefins, usually 1-butene, 1-hexene or 1-octene, and in some instances terpolymers, as for example of ethylene, 1-butene and 1-octene. A process for making VLDPEs is described in European Patent Document publication number 120,503 whose text and drawing are hereby incorporated by reference into the present document.

As for example described in Ferguson et al. U.S. Pat. No. 4,640,856 and Lustig et al. U.S. Pat. No. 4,863,769, VLDPEs are capable of use in biaxially oriented films which have superior properties to comparable films with LLDPEs. These superior properties include higher shrink, higher tensile strength and greater puncture resistance.

Suitable VLDPEs include those manufactured by Dow Chemical Company, Exxon Chemical Company and Union Carbide Corporation, and having the following physical properties in the resin form according to the manufacturers, as summarized in Table A.

TABLE A

VLDPE Physical Properties

| Type | Manufacturer | Property/ ASTM No. | Units | Value |
|---|---|---|---|---|
| SLP 3010B | Exxon (ethylene-butene copolymer) | Melt Index (D-1238) | g/10 min. | 2.2 |
| | | Density (D-792) | g/cc | 0.905 |
| Attane XU61520.01 and 4001 | Dow (ethylene-octene copolymer) | Melt Index (D-1238) | g/10 min. | 1.0 |
| | | Density (D-792) | g/cc | 0.912 |
| | | Tensile Yield (D-638) | psi | 1200 |
| | | Ultimate Tensile (D-638) | psi | 3500 |
| | | Ult. Elongation (D-638) | % | 850 |
| | | Vicat Soften. Pt. (D-1525) | °C. | 95 |
| | | Mw/Mn (D-3593) | none 5.1 (110,600/21,680) | |
| Attane 4003 | Dow (ethylene-octene copolymer | Melt Index (D-1238) | g/10 min | 0.8 |
| | | Density (D-792) | g/cc | 0.905 |
| | | Tensile Yield (D-638) | psi | 950 |
| | | Ultimate Tensile (D-638) | psi | 3200 |
| | | Ult. Elongation (D-638) | % | 800 |
| | | Vicat Soften. Pt. (D-1525) | °C. | 80 |
| DFDA 1137 | Union Carbide (ethylene-butene copolymer) | Melt Index (D-1238) | g/10 min | 1.0 |
| | | Density (D-792) | g/cc | 0.905 |
| | | Tensile Yield (D-638) | psi | 2800 |
| | | Ultimate Tensile (D-638) | psi | — |
| | | Ult. Elongation (D-638) | % | 1720 |
| | | Vicat Soften. Pt. (D-1525) | °C. | 80 |
| | | Mw/Mn (ASTM D-3593) | none 4.9 (125,000 25,700) | |
| DEFD 1192 | Union Carbide (ethylene-butene hexene terpolymer) | Melt Index (D-1238) | g/10 min | 0.19 |
| | | Density (D-792) | g/cc | 0.912 |
| | | Tensile Strength (D-882) | psi | 7100 (MD) 5000 (TD) |
| DEFD 1192 | Union Carbide (ethylene-butene hexene terpolymer) | Ult. Elongation (D-882) | % | 400 (MD) 760 (TD) |
| | | Vicat Soften. Pt. (D-1525) | °C. "low eighties" (reported by mfr.) | |
| | | Mw/Mn (ASTM D-3593) | none 12.2 (196,900/16,080 | |

Linear low density polyethylene (LLDPE) has densities in the range of between about 0.915 and about 0.930 g/cm$^3$. As described by Dr. Stuart J. Kurtz of Union Carbide (which manufactures both VLDPE and LLDPE) in the publication "Plastics and Rubber International" April 1986, Vol. II, No. 2, on pages 34–36, the linear structure and lack of long chain branching in both LLDPE and VLDPE arise from their similar polymerization mechanisms. In the low pressure polymerization of LLDPE, the random incorporation of alpha-olefin comonomers produces sufficient short-chain branching to yield densities in the above-stated range. The even lower densities of VLDPE resins are achieved by adding more comonomer, which produces more short-chain branching than occurs in LLDPE, and thus a lower level of crystallinity. Suitable LLDPE for use in the heat shrinkable bag outer surface of this invention include Dow's Dowlex types 2045 and 2247A. Their physical properties are summarized in Table B.

TABLE B

LLDPE Physical Properties

| Type | Manufacturer | Property/ ASTM No. | Units | Value |
|---|---|---|---|---|
| Dowlex 2045 | Dow LLDPE (ethylene-octene copolymer) | Melt Index (D-1238) | g/10 min | 1.0 |
| | | Density (D-792) | g/cc | 0.920 |
| | | Tensile Yield (D-638) | psi | 1800 |
| | | Ultimate Yield (D-638) | psi | 3800 |
| | | Ult. Elongation | % | 1000 |
| | | Vicat Soften. Pt. (D-1525) | °C. | 100 |
| | | Mw/Mn (ASTM D-3593) | none 4.17 (125,000/30,000) | |
| Dowlex 2247A | Dow LLDPE (ethylene-octene copolymer) | Melt Index (D-1238) | g/10 min | 2.3 |
| | | Density (D-792) | g/cc | 0.917 |

A variety of ethylene vinyl acetates may be used in the patch inner surface and the bag outer surface, and having vinyl acetate contains up to at least 20% of the copolymer total weight. Vinyl acetate contents in the range of 8–12 wt. % are preferred from the standpoint of processability and strength. For the bag outer surface, lower vinyl acetate contents than this preferred range tend to produce poorer shrinkage. Higher VA contents tend to be excessively tacky and difficult to orient. For the patch inner surface, lower VA contents than this preferred range tend to be stiffer and less elastic than preferred for the patch. Higher VA contents tend to be excessively tacky.

TABLE C

EVA Physical Properties

| Type | Manufacturer | Property/ ASTM No. | Units | Value |
|---|---|---|---|---|
| NA 357 | Quantum | Vinyl acetate content | wt. % | 5 |
| | | Melt Index (D-1238) | g/10 min. | 0.3 |
| | | Melting Point | °C. | 102 |
| LD 318.92 | Exxon | Vinyl acetate content | wt. % | 9 |
| | | Melt index (D-1238) | g/10 min. | 2.2 |

TABLE C-continued

| EVA Physical Properties | | | | |
|---|---|---|---|---|
| Type | Manufacturer | Property/ ASTM No. | Units | Value |
| | | Melting Point | °C. | 99 |
| DQDA 6833 | Union Carbide | Vinyl acetate content | wt. % | 10 |
| | | Melt Index (D-1238) | g/10 min. | 0.25 |
| | | Melting Point | °C. | 98 |
| Elvax 3135X | DuPont | Vinyl acetate content | wt. % | 12 |
| | | Melt Index (D-1238) | g/10 min. | 0.25 |
| | | Melting Point | °C. | 95 |
| Elvax 3175 | DuPont | Vinyl acetate content | wt. % | 28 |
| | | Melt Index (D-1238) | g/10 min. | 6.0 |
| | | Melting Point | °C. | 71 |

Since the bag portion of the present article is primarily intended to hold bone-in food products after evacuation and sealing, it is preferred to use a thermoplastic film for this construction which is an oxygen barrier. As the essential outer surface of the bag is not itself an oxygen barrier, if the latter property is needed it must be provided as a separate layer of a multilayer film, most commonly as the core layer. Widely used barrier materials include vinylidene chloride copolymers with various comonomers such as vinyl chloride (VC-VDC copolymer) or methyl acrylate (MA-VDC copolymer). The preferred barrier layer is a blend of about 85% vinylidene chloride-methyl acrylate comonomer and about 15% vinylidene chloride-vinyl chloride comonomer, as for example described in Schuetz et al. U.S. Pat. No. 4,798,251. Other suitable oxygen barrier materials include polyamides and ethylene vinyl alcohol.

The most commonly used barrier-core layer multilayer film for food product-containing bags comprises at least three layers, with a heat sealable layer adhered to one side of the barrier layer and forming the inside layer of the bag converted from the film. As used herein "heat sealable" material refers to a thermoplastic material which will seal to itself or another material when subjected to elevated temperature and/or pressure. EVA is a well-known heat sealable material. Even though heat sealable materials are preferred as the inner layer of the bag-forming thermoplastic material, bags can be sealed after evacuation by mechanical clipping, so a heat sealable material is not essential.

In the preferred three layer thermoplastic film to form the bag of this invention, an impact-abrasion resistant EVA-polyethylene blend is adhered to the opposite side of the barrier core layer to form the bag outer layer. Polyethylenes such as VLDPE and LLDPE have higher impact-abrasion resistance than EVA. This property is desirable for both the patch inner surface and the bag outer surface. On the other hand, the polyethylenes do not provide the high heat shrinkability property needed in the bag, but this is a characteristic of ethylene vinyl acetate. VLDPE provides substantially higher heat shrink than LLDPE. Accordingly, the EVA-VLDPE blend provides both the high abrasion and impact resistance as well as the high heat shrink property needed by the bag outer surface. Preferably the bag outer surface comprises a blend of about 15-65% EVA and 85-65% VLDPE.

It has been discovered that to achieve initial lamination for handling and processing of the patch-bag forming film composite before heat shrink and also prevent delamination of the high surface energy non-heat shrinkable patch inner surface from the high surface energy bag outer surface during shrinkage of the latter around the food mass in the evacuated bag, the physical properties of the patch inner surface must be at least similar to those of the bag outer surface. As will be demonstrated in Example 9, this may be achieved by using EVA or EVA-VLDPE blends as the patch inner surface, and certain EVA types, EVA-VLDPE blends, and EVA-LLDPE blends as the bag outer surface. Preferably, both surfaces are blends of EVA and VLDPE; most preferably they are both about 15-65% EVA and about 85-35% VLDPE. With these compositions, the patch inner surface and the bag outer surface are unexpectedly bonded to each other solely by their respective high surface energies. The EVA content of the bag outer surface should preferably be at least about 15 wt. % because EVA provides relatively high shrink, but should not exceed about 65 wt. % because of the relatively low impact-abrasion resistance of EVA. The VLDPE content of the bag outer surface should preferably be at least about 35 wt. % because VLDPE provides relatively high impact-abrasion resistance, but preferably should not exceed 85 wt. % because VLDPE has lower heat shrink than EVA. The patch inner surface composition is preferably in the same EVA and VLDPE blend range to be chemically similar and provide high bond strength between the high energy surfaces.

The ethylene vinyl acetate contents in the patch inner surface and the bag outer surface are most preferably within about 25 weight % of each other because similar chemistry optimizes the adhesion between the two surfaces. The very low density polyethylene contents of the patch inner surface and the bag outer surface are most preferably within about 25 weight % of each other for the same reason as discussed in connection with the EVA contents, i.e. similar chemistry optimizes adhesion.

For improved processing, the inner and outer layers of the preferred three layer film for the bag both comprise blends of VLDPE and EVA, as for example described in the aforementioned Lustig et al. U.S. Pat. No. 4,863,769. The film comprising the bag is provided either as a flat sheet or as a tube, most commonly the latter. This primary and relatively thick film may be biaxially oriented by the well-known tentering process, but most commonly this is done by the trapped bubble or double bubble technique as for example described in Pahlke U.S. Pat. No. 3,456,044. In this technique an extruded primary tube leaving the tubular extrusion die is cooled, collapsed and then preferably oriented by reheating and reinflating to form a secondary bubble. The film is preferably biaxially oriented wherein transverse (TD) orientation is accomplished by inflation to radially expand the heated film. Machine direction (MD) orientation is preferably accomplished with the use of nip rolls rotating at different speeds to pull or draw the film tube in the machine direction.

The stretch ratio in the biaxial orientation to form the bag material is preferably sufficient to provide a film with total thickness of between about 1.5 and 3.5 mils. The MD stretch ratio is typically 3-5 and the TD stretch ratio is also typically 3-5. An overall stretch ratio (MD stretch multiplied by TD stretch) of about 9-25% is suitable.

The preferred method for forming the preferred multilayer bag film is coextrusion of the primary tube, as for example described in Lustig et al. U.S. Pat. No. 4,714,638. The coextruded primary tube is then biaxially oriented in the manner broadly described in the aforementioned Pahlke Patent. Alternatively, the multilayer film may be formed by extruding a substrate layer and then adding the remaining layers to the substrate by coating lamination, as for example described in Brax et al. U.S. Pat. No. 3,741,253. If two additional layers are to be added to the substrate layer, this may be done sequentially or the two layers may be coextruded and then added to the substrate layer by coating lamination.

Although not essential, it is preferred to cross link the entire bag film to broaden the heat sealing range of the inner layer and also enhance the toughness properties of the inner and outer layers. This is preferably done by irradiation with an election beam at dosage level of at least about 2 megarads (MR) and preferably in the range of 3–5 MR, although higher dosages may be employed. Irradiation may be done on the primary tube or after biaxial orientation. The latter, called post-irradiation, is preferred and described in Lustig et al. U.S. Pat. No. 4,737,391. An advantage of post-irradiation is that a relatively thin film is treated instead of the relatively thick primary tube, thereby reducing the power requirement for a given treatment level. A possible advantage of preorientation irradiation is that if the practioner is using a barrier layer material which tends to discolor on irradiation as for example vinylidene chloride-vinyl chloride copolymer, this problem may be avoided by irradiating only a substrate layer as described in the aforementioned Brax et al. patent.

Alternatively, cross linking may be achieved by addition of a cross linking enhancer to one or more of the layers, as for example described in Evert et al. U.S. Pat. No. 5,055,328. The most commonly used cross linking enhancers are organic peroxides such as trimethylpropane and trimethylacrylate.

Although barrier type multilayer films are preferred for bag fabrication, it should be recognized that for some end uses a barrier material may not be required, as for example poultry type bone-in food masses. In these instances the bag may be monolayer film comprising an EVA-polyethylene blend.

The patch is a blown, non heat shrinkable film which can be either a monolayer or a multilayer construction. Functionally, the patch inner surface must be capable of initially bonding to the bag outer surface solely by high energy treatment of both surfaces and pressure contact. Moreover, the bond must be strong enough to resist delamination when the food-containing bag with a non-heat shrinkable patch is heat shrunk. On the other hand, the patch outer surface must have high puncture strength and resistance to abrasion. All of these properties may be realized in 100% EVA or 100% VLDPE monolayer patches or certain types of EVA-VLDPE blends as a monolayer. For the monolayer blend patch embodiment, the blend preferably comprises 15–65% EVA and 85–35% VLDPE, with a 50% EVA–50% VLDPE blend most preferred. Alternatively, the patch may comprise at least two layers: an inner layer with an inner surface suitable for high surface energy lamination to the bag outer surface, and an outer layer with an outer surface providing high external abrasion resistance and puncture resistance. If the patch inner layer is formed of material having relatively low puncture resistance as for example EVA, the patch outer layer preferably also provides puncture protection against sharp edges of the food body. For this reason, the preferred multilayer patch with a 100% EVA inner layer has an outer layer comprising 15–25% EVA and 75–85% VLDPE. The high VLDPE content provides additional protection against internal puncture.

If additional puncture resistance is needed, the patch may be irradiated, and preferably at dosage of at least about 5 MR.

Figure 1:
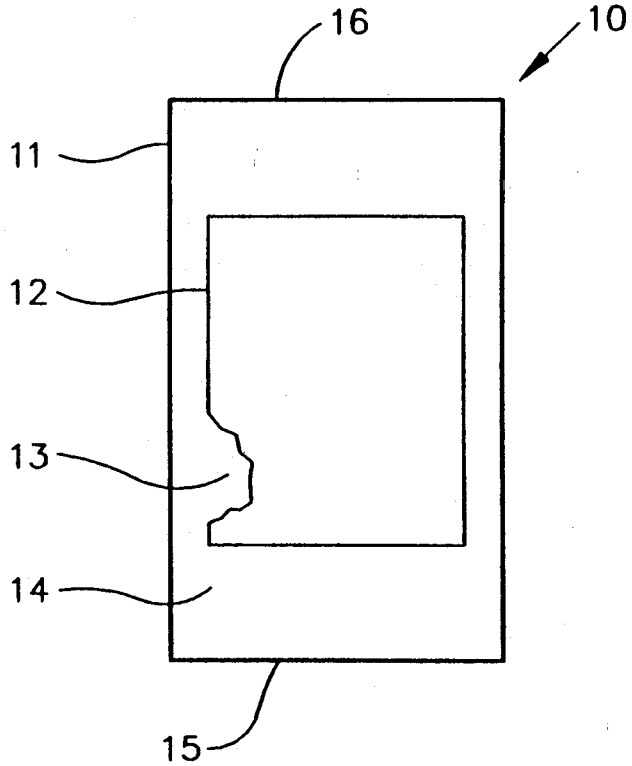
FIG. 1 schematically depicts a plan view of a patch bag embodiment of the invention, FIG. 2 schematically depicts an elevation view of a bone-in food package embodiment of the invention using the FIG. 1 patch bag.

FIG. 1 is a schematic drawing of a plan view of a patch bag 10 fabricated according to this invention and comprising a biaxially oriented heat shrinkable relatively thin-walled thermoplastic film bag 11 and non-heat shrinkable relatively thick-walled thermoplastic film patch 12 bonded to an outer surface of the bag. Patch 12 preferably covers less than the entire surface area of at least one side of bag 11. Both the patch 12 inner surface and at least the bag outer surface portion 13 coextensive with the patch inner surface have been exposed to high energy as for example corona discharge, so as to be characterized by high surface energy of at least about 38 dynes/cm as the sole bonding means therebetween. This surface energy is sufficient so that when the patch bag 10 is filled with bone-in food mass as for example beef loin subprimal cuts, evacuated, sealed and heat shrunk around the bone-in food mass, the bag outer surface portion 13 bonded to the patch shrinks to a lesser extent than the remainder 14 of the bag, but the patch 12 does not delaminate from the bag 11.

Bag 11 generally comprises two sides having interior and exterior faces, a closed end 15 and an opening 16 into the interior of the bag opposite end which is often referred to as the mouth of the bag.

FIG. 2 is a schematic drawing of a food package 20 prepared according to this invention, comprising a heat shrunk and relatively thin-walled thermoplastic film bag 21 containing bone-in food mass 22 in an evacuated and sealed space within the bag, such that the mass 22 outer surface with protruding bones 23 is in direct supporting relationship with the collapsed bag inside surface. The bag mouth is sealed, preferably by a heat bond 24 between the bag inner surfaces.

A non heat shrinkable and relatively thick-walled thermoplastic film patch 25 is provided with the patch inner surface positioned over any protruding bones 23. The non heat shrinkable patch inner surface and the heat shrunk patch outer surface are bonded together solely by contacting each of these surfaces having high surface energy of at least about 38 dynes/cm. When the bag is heat shrunk, the strength of the existing patch-bag bond increases and the bag portion adhered to the patch shrinks to a lesser extent than the nonpatched remainder 26 of the bag. This is because of the extremely strong high surface energy patch-bag bond which restrains shrinkage of the covered bag portion. But because of this extremely strong patch-bag bond the patch does not delaminate from the bag.

Figure 3:
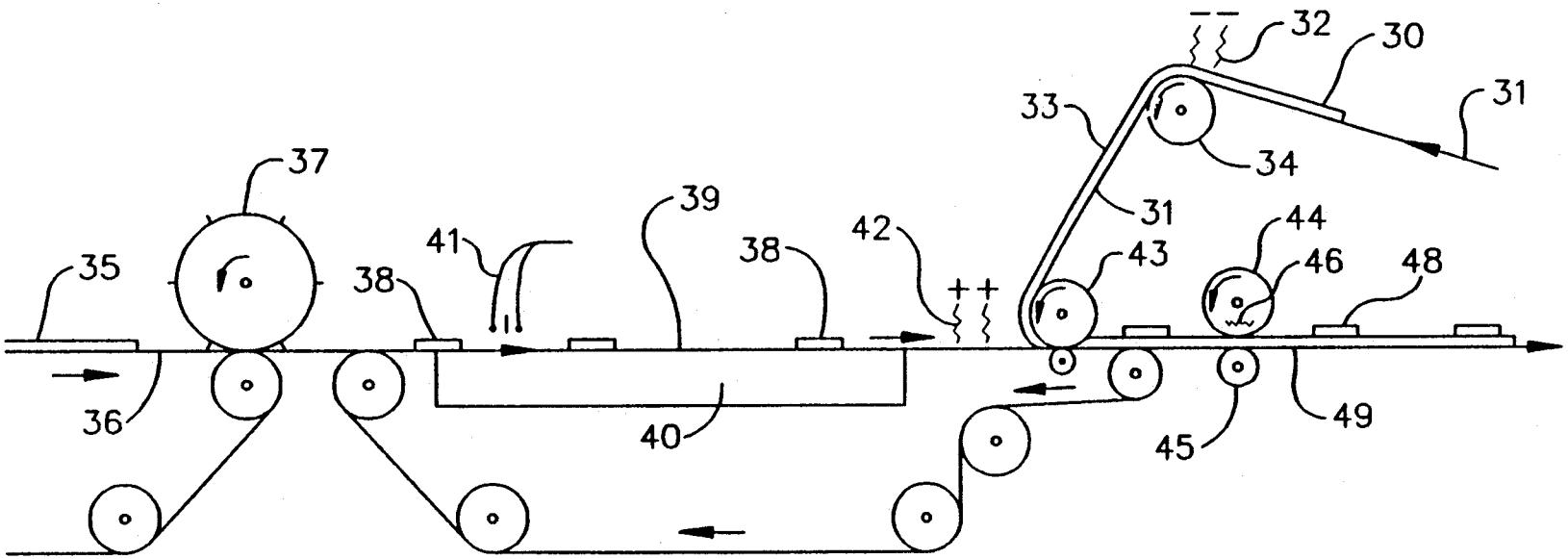
FIG. 3 schematically depicts a system for manufacturing the FIG. 1 patch bag, and FIG. 4 schematically depicts a system for packaging bone-in food mass using the FIG. 1 patch bag.

FIG. 3 is a schematic drawing of a preferred system for manufacturing the FIG. 1 patch bag, in which the flattened tubular film 30 having high energy on its exterior surface and ultimately used to fabricate the bags (hereinafter "bag film") is introduced on upwardly inclined roll 31. It passes beneath negative static generator 32 which imparts a negative change of about 15 kv to the high energy surface. The purpose of this charge is to insure a static cling with the positively charged patch surface (hereinafter discussed) as the two mate at the nip rollers. The negatively charged high surface energy bag film 33 is downwardly directed by idler roll 34, still on roll 31.

At the same time, patch stock with high energy top surface 35 is introduced on horizontal conveyor belt 36 and passes beneath rotary cutter 37 where the stock is transversely severed into longitudinally spaced patches 38, and transferred to horizontal support roll 39 for movement by air fingers. The distance between adjacent patches and the conveying speeds of the patch and bag film are arranged so that the two components are mated in the desired manner. Patches 38 are horizontally moved on support roll 39 over vacuum chamber 40 where the applied vacuum maintains the patches in the desired spaced positions. The patches initially travel beneath static eliminator 41 and then beneath positive static generator 42 which imparts a positive charge of about 15 kv to the patch high energy to surface.

Bag film 33 and patches 38 are mated on conveyor 39 under slight pressure between soft rubber marriage roller 43 and a support roller. The composite patch-film is then fed through the nip roller system comprising hard rubber upper roller 44 and steel lower roller 45 to form an initial bond. Satisfactory initial bond laminations have been produced with pressures of about 40 psi and about 2500 psi on the patch-bag film composite, and probably lower or higher pressures would be satisfactory. Loading pressures of 40100 100 psi. are preferred. The preferred temperature for nip rolls 44 and 45 using VLDPE-EVA blends for both bonding surfaces is about 100°-110° F. The rolls may be heated by electric coils 46 to maintain this temperature level in cold weather.

The resulting initially bonded bag film-spaced patch article 48 is discharged from the nip rolls 45-46 onto conveyor 49 for further processing as for example described in connection with FIG. 4.

Figure 4:
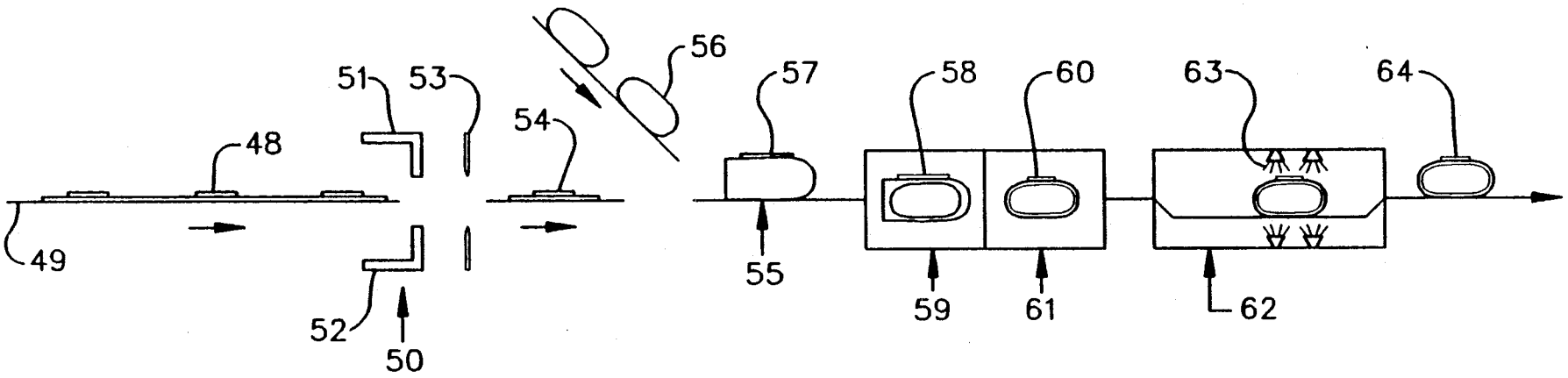

FIG. 4 is a schematic drawing of a system for manufacturing the food package of this invention from the initially bonded bag tube film-spaced patch article 48 of FIG. 3. This article may for example be stored in roll form, converted by the manufacturer into patch bags and sold to the food processor for use in forming the food packages of this invention. Alternatively, the entire sequence may be performed at one location in an "in-line" system as depicted in this FIG. 4.

More specifically, the initially bonded bag tube film-spaced patch article 48 in lay-flat form is moved by conveyor 49 to sealing and bag forming station 50. The latter comprises upper and lower sealing jaws 51 and 52, and bag severing means 53. The combined action of these elements may be arranged, as is well known in the art, such that the leading edge of article 48 is open so as to define the mouth or open end of the bag being formed. Jaws 51 and 52 cooperate to make a transverse heat seal to bond the opposite end of a same bag, and severing means 53 separates that patch bag 54 from the open end of the next successive bag. It will be understood that many other methods of bag formation from a tube are well known to those skilled in the art, and any of these may be used to convert the initially bonded bag tube—spaced patch article into the patch bag of this invention.

The patch bag 54 is next moved to bag opening and filling station 55 which may for example include gas inflation means (not illustrated). Bone-in food mass 56 is introduced in opened patch bag 57 and positioned so that any protruding bones are located beneath the patch. Then the open patch bag-containing bone-in food mass 58 is moved to evacuation station 59 where the bag interior is evacuated so the bone-in food mass outer surface directly supports the collapsed bag inside surface. The evacuated but open mouthed bone-in food mass-containing patch bag 60 is then sealed either by clipping or preferably by a transverse heat seal across the bag mouth, at heat sealing station 61. Suitable means for accomplishing the evacuating and sealing steps are for example disclosed in Kuehne U.S. Pat. No. 4,534,984 and Kupcikevicius U.S. Pat. No. 5,062,252, both incorporated herein by reference.

Finally, the evacuated and sealed bone-in food mass-containing patch bag is passed through shrink tunnel 62 where the bag is heat shrunk as for example by upward and downward sprays 63 of hot water at for example 195° F. The bag is heat shrunk against the bone-in food mass outer surface and the bond between the high surface energy treated bag outer surface and patch inside surface is simultaneously increased is a second bond enhancement step. The bag portion adhered to the patch shrinks to a lesser extent than the remainder of the bag, but this enhanced strength bond is sufficient to prevent delamination of the non-heat shrinkable patch from the heat shrunk bag. The resulting food package 64 discharged from hot shrink tunnel 62 is cooled to slightly above freezing temperature such as 35° F. by means not illustrated, and comprises the FIG. 2 food package of this invention.

For comparison with the prior art, a series of shaker tests were performed using as the control, a commercial patch bag product sold by Viskase Corporation as E-Z GUARD ® patch bag. This product was commercially successful in terms of meeting food processor requirements for packaging and transporting bone-in beef. This commercially employed product had a collapsed bubble-type heat shrinkable multilayer film patch comprising an ethylene methyl acrylate (EMA) core layer and inner and outer layers each comprising about 40% EVA, 40% LLDPE and 20% VLDPE. The patch was about 5 mils thick, irradiated to about 10 MR and bonded to the bag outer layer by a water-based adhesive. The bag was Viskase Corporations's commercially employed PERFLEX type comprising a heat shrinkable three layer film with an oxygen barrier-core layer comprising a blend of 85% MA-VDC copolymer and 15% VC-VDC copolymer. The inner and outer layers were 75% VLDPE (Union Carbide type 1192) and 25% EVA (Union Carbide type 6833). The bag thickness was about 2.25 mil. The bag was heat shrinkable to the extent of about 30-35% in both the machine and transverse directions. The patch was heat shrinkable to the extent of about 25-30% in both directions.

The same type bag was used to fabricate the test bags, except that in most instances bag thickness was 3.25 mils. The significance of this difference is discussed is connection with Example 9.

In certain of the prior art patch bags used in these adhesion tests (other than the aforementioned E-Z GUARD patch bag), the experimental patches were adhered to the bag-forming tubular film by water-based or organic solvent based adhesion. For the remainder of the experimental patch bag, the patch material was extruded in tubular form, and longitudinally slit to form a flat sheet which was corona treated to impart high wetting tension of about 42 dynes/cm on one side. The aforedescribed bag film was also extruded in tubular form and its outer surface corona treated to impart high wetting tension of about 42 dynes/cm. Nonadhesive slip sheets were applied to the patch (at desired longitudinal spacing) and bag film high energy surfaces to prevent blocking, and each was wrapped in roll form. Corona treatment was performed by a covered roll multiple electrode treater using apparatus identified by the manufacturer, Pillar Company of Hartland, WI as Model AB 1326-1A. Corona treatment may also be done with bare roll type apparatus.

To form the patch-bag laminate, the two rolls were longitudinally intertwined by rewinding as a single roll so that the high surface energy patch portion was placed on the bag outer surface at the predetermined longitudinal intervals. More specifically each patch was about 21¾ inches long × about 16¾ inches wide, and was centered on the 17 inch wide bag outer surface with about 8¾ inches spacing between the ends of adjacent patches.

The patch-bag laminate was stored at least 12 hours under roll pressure to allow the initial bonding of the two high energy surfaces. Initially this storage period was 2–3 days (Examples 1 and 2), and then the patch-tubular substrate laminate was converted into patch bags. For Examples 3–8, the tubular substrate bag film was heated to 105°–115° F. after corona treatment and then immediately intertwined with the patch by the rewinder. In this manner, the patch-tubular substrate bag laminate was rolled up with internal heat which accelerated initial bonding between the two high energy surfaces. When this was done, the initial bond was sufficiently strong after 12 hours storage for conversion into bags. In effect, this 12 hour storage provided curing time for the initial bonding to occur.

As hereinafter discussed in more detail, the patch-bag bond was strengthened when the bone-in food containing package was heat shrunk. For Examples 1–8, this packaging was done about 14 days after the initial patch-bag film bonding.

In the abrasion shaker tests, a standard type and size of sub primal beef rib cut from a standard primal beef rib cut was placed in a variety of patch bags, evacuated and heat sealed. The heat sealed packages were heat shrunk by external contact with hot water sprays, so that the heated patch bag inner surface shrunk over the outer surface of the sub primal beef rib. After chilling, the heat shrunk packages were placed in open cardboard boxes (three side-by-side packages per box) of a size commonly used in the beef packaging industry, the relative sizes of the packages and the box being such that the packages loosely fit against each other and would slide when the box was mechanically shaken. The packages were examined to insure that no bones protruded from unpatched areas of the packages. To simulate typical abrasion-producing in-transit movement of these boxes between the slaughter house and the wholesaler/retailer, the boxes were placed on a shaker table which moved in a rolling circle path. At the end of each 15 minute shaking period, the packages were inspected for breakage and/or separation of the patch from the bag. This sequence was repeated for a total shaker time of 120 minutes, the latter being arbitrarily selected as simulating a representative duration of movement between contiguous packages and the box walls during in-transit shipment of bone-in meat. Since the severity of the abrasion contact is somewhat dependant on where a particular package is placed in the box as well as the extent of rib protrusions in a particular cut piece, each cut was placed in each type patch bag, and each type package was placed in different positions in the box.

The data from these shaker tests was organized in terms of survival time without failure, i.e. breakage due to external abrasion or puncture of the patch and the patch-covered bag irrespective of the cause. The arithmetic average survival time without failure was calculated for each type of patch bag (in minutes) as well as the standard deviation (in minutes) from the average survival time. The actual total survival time for all tested bags of a particular type was determined by addition, and calculated as a percentage of maximum possible survival time based on an arbitrary total survival time of 135 minutes. The abrasion performances of the patch bag types used in a particular experiment were then compared on a qualitative rather then quantitative basis. That is, the survival time information may be compared to determine if two types of patch bags provide similar or substantially different abrasion performance.

By way of background on the bone-in meat cuts used in these abrasion tests the National Association of Meat Purveyors (NAMP) assigns certain numbers to certain beef cuts, for example the primal beef rib is No. 103 and the regular oven-prepared sub primal beef rib prepared from this primal cut is No. 107. To qualify for this designation, the short ribs are removed from No. 103 by a straight cut from a point on the 12th rib which is not more than 3 inches (76 mm) from the outer tip of the ribeye muscle through a point on the 6th rib which is not more than 4 inches (102 mm) from the outer tip of the ribeye muscle. The chine bone is removed by a cut which exposes lean meat between the feather bones and the vertebrae, leaving the feather bones attached. The blade bone and related cartilage is removed. The target weight for No. 107 beef rib for these experiments was 22 lbs. and each rib was about 14–15 inches long.

Only No. 107 beef rib cuts were used in the abrasion shaker tests and one sub primal cut was placed in each bag, with the chuck (large) end at the bag bottom. The bags were 17 or 18 inches flat width and about 30 inches long.

The aforedescribed film used to fabricate the bags was prepared by coextrusion and biaxially oriented by the double or trapped bubble technique, the proportions of the oriented film layer thicknesses being 27% (outer)/10% (core)/63% (inner). The biaxially oriented film was post irradiated at dosage of about 4 MR.

Before insertion in the patch bags, the sub primal beef rib cuts were first conditioned by placement in non test patch bags and vibrated/oscillated for 2 hours on the shaker table to round off the sharpest protruding bones. This was done to insure that at least most of the test patch bags would survive the initial period of the shaker abrasion test, and meaningful experimental information could be developed.

The beef rib sub primal cut-containing patch bag was evacuated to an absolute pressure on the order of 60 mm. Hg. and impulse heat sealed across the top in a Super Vac® machine manufactured by Smith Equipment Company, Clifton, N.J. The evacuated packages were then processed through a commercial-type shrink tunnel wherein the packages were moved on a conveyer belt through downward and upward hot water sprays at 195° F. for a contact time of about 1½ seconds. The heat shrunk packages were chilled for at least 12 hours at 35° F. The chilled heat shrunk packages were externally dried and placed side-by-side lengthwise resting on the feather bones in open cardboard boxes of about 20.5 inches × 17.25 inches × 10 inches with three packages per box. To obtain representative loading configuration alternate boxes were loaded L-R-L and R-L-R in terms of left side cuts and right side cuts.

The boxes were placed on a shaker table manufactured by Gaynes Engineering Company, Chicago, Ill. The shaker motion was a rolling circle of about 1 inch diameter, at a rate of 100 cycles per minute.

EXAMPLE 1

The purpose of this experiment was to visually qualitatively compare the adhesion of a low density polyethylene (Exxon's type LD 134.09 LDPE) of about 0.922 g/cm$^3$ density blown film non heat shrinkable 4 mil thick patch on a bag of 18 inches flat width × about 30 inches flat length (sample 1) with that of the aforementioned biaxially oriented, heat shrinkable, commercially used patch adhered to the same type of commercially used bag (sample 2) in bone-in meat packages. One patch bag of each type was prepared.

In this instance the sample 1 patch was irradiated to 10 MR and adhered to the bag by a commercially available water based acrylic adhesive, Northwest Adhesive Company's Product, NW No. 707. The adhesive was applied to the patch material, and the article was placed in an oven to evaporate excess moisture to a water content of about 8% of the adhesive weight. A paper slip sheet was placed over the adhesive-containing patch surface and the patches were cut to size. The patch was joined to the tubular bag film outer surface under light pressure of about 2 psi, the patch-film composite rolled, and the roll was stored for about 3 days. During this period the roll compression on the patch-film increased to about 15 psi.

The sample 2 control had good adhesion of the patch to the bag with minor release noted at the patch corners. The experimental sample 1 had severe release in areas where the patch was not directly over the meat. Example 1 demonstrated that a non-heat shrinkable LDPE blown film patch was not satisfactory when adhered to the bag by a conventional water-based adhesive.

EXAMPLE 2

The purpose of this experiment was to qualitatively compare the abrasion resistance of a 10 MR irradiated 50% EVA (Union Carbide type 6833) - 50% VLDPE (Dow's type XU 61520.01) blown film non-heat shrinkable 5 mil thick patch on a 17 inch flat width bag (sample 3) with that of the aforementioned E-Z GUARD patch bag (biaxially oriented patch adhered to the same type of commercially used bag) as sample 4. The adhesive and patch-bag film bonding procedure for sample 3 was the same as described in Example 1. The results of these tests are summarized in Table D. The latter shows that the experimental bags were markedly inferior to the commercial control bags, and would not satisfy commercial standards. Accordingly, Example 2 demonstrated a 50% EVA - 50% VLDPE blown film patch was not satisfactory when adhered to the bag by conventional water-based adhesive.

EXAMPLE 3

The purpose of this experiment was to test the effectiveness of an organic solvent-based adhesive as the bonding agent for a 100% LLDPE (type Dowlex 2045 manufactured by Dow, density 0.920 g/cm$^3$) nonirradiated blown film patch having 0% shrinkability to the outer surface of the aforedescribed commercially employed multilayer oxygen barrier PERFLEX type heat shrinkable film with a 75% VLDPE—25% EVA outer layer. The organic solvent-based adhesive was AROSET® type 1085-Z-85 pressure sensitive adhesive described by its manufacturer, Ashland Chemical Company, as a thermosetting acrylic solution polymer. Because of its organic content, the manufacturer recommends that after application, the adhesive-containing body be heated to at least 250° F. to maximize effectiveness of the adhesive, volatilize the organic residue and remove odor traces which are characteristic of organics.

In this experiment, the adhesive was applied to both the inner surface of the 4 mil thick patch of blown film comprising 100% LLDPE having a Vicat softening point of about 212° F., and the outer surface of the aforedescribed three layer 3.25 mil thick film material. The patch-film combination was bonded at room temperature under slight contact pressure, e.g. 10 psi. A higher curing temperature was not used because the softening point of the LLDPE in the patch and the EVA and VLDPE film outer layer blends were all below 250° F. It was noted that noxious fumes were present even at the lower as-practiced room drying temperature, so that a special venting and exhaust system would be needed for commercial practice at this less than optimum temperature level.

After conversion to patch bags, these test bags as sample 5 were loaded with No. 107 beef ribs, evacuated, sealed and immersed in hot water, then subjected to abrasion testing along with heat shrinkable control patch bag sample 6 (identical to heat shrinkable patch bag sample 4). The results of these tests are summarized in Table D. The latter shows that the experimental bags were markedly inferior to the commercial control bags and would not satisfy commercial standards. Example 3 demonstrated that organic solvent-based adhesives are not suitable for bonding a non-heat shrinkable LLDPE-containing blown film patch to a heat shrinkable bag having a VLDPE-EVA outer surface.

EXAMPLE 4A

The purpose of this experiment was to qualitatively demonstrate the effect of shrink tunnel heating on patch-to-bag bonding by corona treatment. The blown non-heat . shrinkable patch film was 5 mils thick, and comprised a 50% VLDPE (Dow type XU61520.0-1)—50% EVA (Union Carbide type 6833) adhered to a 3.25 mil thick three layer heat shrinkable barrier film having an outer layer comprising 75% VLDPE (Dow type 4001)—25% EVA (Union Carbide type 6833). The patch inner surface and the bag film outer surface were separately corona treated so as to provide surface energy of at least about 42 dynes/cm$^2$.

The patch bags were prepared and filled with No. 107 beef ribs, evacuated and sealed. Prior to hot water shrinking, the patches were visually inspected and found to be firmly bonded to the bag outside surface. However, with a moderate effort the patch could be pulled off the bag. After heat shrinking there was no visual evidence of patch delamination and it was noticeably more difficult to manually pull the patch away from the bag.

This experiment demonstrates that in the practice of the present invention the non-heat shrinkable patch-heat shrinkable bag bond is significantly strengthened by hot water shrinking the bag around a bone-in meat mass.

EXAMPLE 4B

The purpose of this experiment was to quantitatively demonstrate the effect of shrink tunnel heating on non-heat shrinkable patch-to-heat shrinkable bag bonding by corona treatment, using a peel strength test.

Sections of the same patch bag composite used in Example 3A were used in the experiment, one section being heat shrunk by a hot water immersion procedure very similar to that described in ASTM D-2732 to simulate typical shrink tunnel operating conditions. The only significant differences from the ASTM procedure were that the patch bag sample was immersed in 90° C. water for five seconds and air dried. The peel strength tests were performed on an Instron Table Model Tensile Testing Machine manufactured by Instron Corporation, Canton, Mass. and equipped with a COF stationary (horizontal) plane, using a procedure derived from ASTM-D 903. The samples were cut 8 inches long in the machine direction (MD) across the sheet, and 1 inch long in the transverse direction (TD). A corner of the sample was dipped in xylene and the patch partially separated by manually slowly pulling apart at a 180° angle starting at the corner, to separate 1–2 inches in the MD and across the TD.

The partially separated patch end was connected by a ¾ inch long standard office-equipment type binder clip through an 8 lb. test monofilament fishing line and secured to the longitudinal stationary plane by a jaw holder. After calibrating the load cell to a full scale load of 1 lb., the crosshead was set to pull at 1 inch/minute and the test was run. Maximum, minimum and average peaks in force were read from the chart, and the average force in grams to separate the patch from the bag was calculated from the average peak height.

Four samples were tested from each specimen and arithmetically averaged. Patch-bag adhesion prior to the shrinking was 180 grams/inch. Patch-bag adhesion after shrinking was 365 grams/inch, and failure was due to delamination of the multilayer bag film, not the bag-patch bond.

This experiment demonstrates that from a quantitative standpoint, the non-heat shrinkable patch-heat shrinkable bag high surface energy bond is substantially increased by the heat shrinking step.

As previously indicated, in the practice of the invention the patch inner surface and the bag outer surface should have high surface energy of at least about 38 dynes/cm wetting tension as the sole bonding means therebetween. The bond strength increases with increasing surface energy, but there is no need to provide a bag-patch bond which is stronger than the lamination strength of a multilayer bag film. The preferred energy levels of the patch inner surface and bag outer surface is 44 to 46 dynes/cm wetting tension.

EXAMPLE 5

The purpose of this experiment was to compare the patch abrasion resistance of a bone-in food package of this invention with a commercially employed heat shrinkable patch type package. Sample 7 used a 50% VLDPE (Dow type XU61520.01) - 50% EVA (Union Carbide type 6833) 5 mil thick blown film patch irradiated to 10 MR and bonded to the aforedescribed 3.25 mil thick bag with a 75% VLDPE-25% EVA outer layer solely by high surface energy from corona treatment. Sample 8 was the aforedescribed commercially employed heat shrinkable patch bag (E-Z GUARD patch bag) which was identical to samples 4 and 6.

The results are summarized in Table D. The latter shows that the invention package is equivalent to the heat shrinkable patch type bag commercial package in terms of abrasion resistance.

EXAMPLE 6

The purpose of this experiment was to compare the patch abrasion resistance of a bone-in food package of this invention using a 75% VLDPE-25% EVA patch with an otherwise identical package using a 50% VLDPE-50% EVA patch, in the context of a commercially employed heat shrinkable patch type package. Sample 9 included a 75% VLDPE (Dow type XU61520.01 with 0.9 MI) - 25% EVA (Union Carbide type 6833 with 0.25 MI) 5 mil thick patch irradiated to 10 MR and bonded to the aforedescribed 3.25 mil thick bag with the 75% VLDPE-25% EVA outer layer, and sample 10 was identical to previously described sample 7. The only difference between samples 9 and 10 was the VLDPE-EVA blend in the blown film patch. Sample 11 used the previously described E-Z GUARD control heat shrinkable patch type patch bag which was identical to samples 4, 6 and 8.

The results of this experiment are summarized in Table D. They show that in terms of abrasion resistance the 75% VLDPE-25% EVA nonshrinkable patch and the 50% VLDPE-50% EVA nonshrinkable patch embodiments of the invention are equivalent, and both are equivalent to the heat shrinkable commercial patch type bag.

A preferred patch material for practicing this invention is a monolayer comprising between about 25–50% ethylene vinyl acetate and about 75%–50% very low density polyethylene.

EXAMPLE 7

The purpose of this experiment was to compare the patch abrasion resistance of bone-in food packages using a LDPE (type LD 134.09 manufactured by Exxon, density 0.922) non heat shrinkable blown film patch irradiated to 10 MR and adhered to a bag solely by high surface energy from corona treatment (sample 12, with the aforedescribed commercially used E-Z GUARD heat shrinkable patch bag (sample 13).

Sample 12 used a 3.25 mil thick bag. Sample 13 was the control and used the same type heat shrinkable patch bag as in samples 4, 6 and 8. The results of the abrasion tests are summarized in Table D, and demonstrate that the LDPE blown film corona laminated patch bag is substantially inferior to the control heat shrinkable patch bag, so would not be commercially acceptable.

EXAMPLE 8

The purpose of this experiment was to determine the effect of using high melt index EVA and VLDPE patch constituents on the patch abrasion resistance of bone-in food packages wherein the patch and bag are bonded by high surface energy from corona treatment. Sample 14 used a 10 MR irradiated 50% EVA (Exxon's type D318.92, MI 2.2) - 50% VLDPE (Exxon's Exact type 3010B, MI 2.2) blown film 5 mils thick patch with 0% heat shrink and a 3.25 mil thick bag. The latter's outer surface comprised the aforedescribed 75% Union Carbide type 1192 VLDPE (0.19 MI)—25% EVA (0.25

MI). Sample 15 used the previously described commercially employed heat shrinkable E-Z GUARD patch bag.

The abrasion test results are summarized in Table D, and show that the high melt index patch embodiment of this invention has significantly better abrasion resistance than the commercially employed heat shrinkable patch bag. Since the lower melt index VLDPE-EVA corona bonded patch bag embodiments used in previously described Examples 5 and 6 demonstrated equivalent performance to the E-Z GUARD patch, patches with an inner surface comprising a blend of at least 2 melt index EVA and at least 2 melt index VLDPE are preferred in the practice of this invention.

The PERFLEX bag materials irradiated at 3 MR (EVA type) and 4 MR (EVA/VLDPE type). The TUF SEAL 90 and II bags are believed to have been irradiated at about 4 MR.

Lamination strength was measured by the procedure derived from ASTM-D903 and described in Example 4B, using an Instron Table Model Testing Machine to determine the force (in grams) required to pull the patch bag films apart. It should be noted however, that whereas the Example 4B samples were immersed in hot water to simulate shrink tunnel treatment prior to the peel test, in this instance the samples were not heat shrunk. The results of the experiments are summarized in Table E.

TABLE D

| | | | Shaker Abrasion Tests - Patch Screening | | | | | | | | | | |
|---|---|---|---|---|---|---|---|---|---|---|---|---|---|
| | | | Pkg. Failure Distribution (minutes) | | | | | | Pkg. | Survival Time | | | |
| Sample 2 No. (b) | Type (a) | No. Bags Tested | 15 | 30 | 45 | 60 | 75 | 90 | Survival 120 | Ave. (min) | S.D. (min) | Act. Total (min) | % max |
| 3 | water based adhesive | 10 | 2 | 3 | 1 | 3 | 1 | | 0 | 27 | 14 | 270 | 20 |
| 4 | control | 10 | 4 | 5 | | 1 | | | 2 | 42 | 21 | 420 | 31 |
| 5 | solvent based adhesive | 12 | 7 | 1 | 3 | | | | 1 | 31 | 27 | 375 | 23 |
| 6 | control | 12 | 6 | | 1 | 1 | 1 | | 3 | 52 | 47 | 630 | 39 |
| 7 | corona bond | 12 | 7 | | 1 | | 2 | | 2 | 47 | 47 | 570 | 35 |
| 8 | control | 12 | 6 | 2 | 1 | | | | 3 | 50 | 52 | 600 | 37 |
| 9 | 75-25 patch | 12 | 8 | | 3 | 1 | | | 0 | 26 | 17 | 315 | 19 |
| 10 | 50-50 patch | 12 | 8 | | 3 | | | | 1 | 29 | 34 | 345 | 21 |
| 11 | control | 12 | 8 | 2 | 1 | | | 1 | 0 | 26 | 22 | 315 | 19 |
| 12 | LDPE Patch-corona | 12 | 8 | 3 | | | | | 11 | 29 | 34 | 345 | 21 |
| 13 | control | 12 | 6 | 1 | 1 | | | | 4 | 53 | 52 | 645 | 40 |
| 14 | High MI Patch | 12 | 8 | 2 | | | | | 2 | 17 | 6 | 1620 | 13 |
| 15 | control | 12 | 10 | 2 | | | | | 0 | 26 | 20 | 1620 | 19 |

(a) All control patch bags were E-Z GUARD.
(b) Samples 7, 9, 10 and 15 are invention embodiments.

EXAMPLE 9

The purpose of these experiments was to compare corona treated patch-to-bag bonding after corona treatment, but without shrink tunnel heating, using different compositions of patch inner surface—bag outer surface. It will be recalled that in the preceding examples, all invention embodiments were EVA-VLDPE blends for both surfaces. In these experiments four (4) different bag outer surface compositions used: the previously described 75% VLDPE-25%. EVA Viskase PERFLEX as a control, a 100% EVA (Union Carbide type 6833 with 10% vinyl acetate), a TUF SEAL 90® bag sold by American National Can Company and believed to have a 100% EVA outer surface, and a TUF SEAL II bag sold by American National Can Company and believed to have an EVA-LLDPE blend outer surface. Eight (8) different patch inner surface compositions were used, including the preferred sample 14 (Example 8) 50% VLDPE (MI 2.2) - 50% EVA (MI 2.2). The combination of this patch material and the Viskase commercially employed PERFLEX bag comprising 75% VLDPE - 25% EVA is identical to the sample 14 patch-bag combination, and is the control for the experiments.

In these experiments the patch materials were 5 mils thick and the bag materials were 2.25 mils thick. The terms "patch" and "bag" are used for consistency with the terminology in this specification, but unlike the preceding examples, the actual samples used in these experiments were in single sheet form. However, these samples were corona treated to impart high wetting tension of about 42 dynes/cm, and laminated in exactly the same manner as the previously described patch bags. The patch materials were irradiated at 10 MR.

TABLE E

| | Corona Lamination Strength Bag Outer Surface | | | |
|---|---|---|---|---|
| Patch Inner Surface (wt. %) | 25% EVA/ 75% VLDPE (PERFLEX) | 100% EVA (PERFLEX) | EVA (TUF SEAL 90) | EVA/LLDPE (TUF SEAL II) |
| 100% EVA[1] | 14.1 | 0 | 17.7 | 7.3 |
| 75% EVA/ 25% VLDPE[2] | 10.1 | 0 | 10.0 | 6.8 |
| 50% EVA/ 50% VLDPE[2] | 11.8 (control) | 0 | 11.4 | 8.6 |
| 25% EVA/ 75% VLDPE[2] | 37.2 | 0 | 56.3 | 13.2 |
| 100% LLDPE[2] | 0 | 0 | 0 | 0 |
| 50% EVA/ 50% LLDPE[3] | 0 | 0 | 0 | 0 |
| 50% EVA/ 50% Plastomer[4] | 0 | 0 | 0 | 0 |
| 50% EVA/ 50% | | | | |

TABLE E-continued

| Patch Inner Surface (wt. %) | Corona Lamination Strength Bag Outer Surface: 25% EVA/ 75% VLDPE (PERFLEX) | 100% EVA (PERFLEX) | EVA (TUF SEAL 90) | EVA/LLDPE (TUF SEAL II) |
|---|---|---|---|---|
| HDPE[5] | | | | |

[1]The EVA used in all patch inner surfaces was Exxon's LD 318.92 (9.0% VA, 2:2 MI)
[2]Exxon's Exact SLP-3010B (0.906 density, 2.2 MI)
[3]Dow's Dowlex 2247A (0.917 density, 2.3 MI)
[4]Mitsui's Tafmer A1085 (0.885 density, 1.4 MFR)
[5]Union Carbide's DGDA 6093 (0.953 density, 0.15 MI)

It should be recognized that the Table E peel strength data is not a quantitative measure of the corona treated patch-to-bag lamination strength in commercial practice. This is because the lamination strength is substantially increased by shrink tunnel heating the food-containing package, as qualitatively and quantitatively demonstrated by Examples 4A and 4B respectively. However, to be functional, there must be sufficient patch-to-bag lamination strength from the individual components' corona treatment and pressure contact so that the composite may be processed through the several steps of bag formation, storage, filling with food, and movement to the shrink tunnel.

Table E shows that only patches with inner surfaces comprising EVA or EVA and VLDPE blends provided corona lamination strength. That is, the 100% LLDPE, 50% EVA/50% LLDPE, 50% EVA/50% plastomer and 50% EVA/50% HDPE patch-to-bag combinations had no corona lamination strength. Since they could not be processed in this loose form, they are unsuitable for practice of the invention. The EVA/VLDPE bag outer surface tests demonstrate that from the corona lamination standpoint alone, a 100% EVA patch and 25 to 75% EVA—75 to 25% VLDPE patches were all suitable, with the 25%-75% VLDPE patch providing the highest corona lamination strength. That is, all of these samples have sufficient bond strength for the composite to maintain structural integrity during the processing steps up to the shrink tunnel. From this data, it appears that a 100% VLDPE patch inner surface or bag outer surface would also be suitable to practice the invention. Even though the 100% EVA patch inner surface is satisfactory from the corona lamination standpoint, it may not be suitable for packaging some bone-in meats because of its relatively low puncture strength compared to VLDPE. From this standpoint, the EVA and VLDPE blends are preferred as bag outer surface compositions.

Table E shows that the PERFLEX 100% EVA (Union Carbide's 6833, 10% VA and 0.25 MI) is not a suitable bag outer surface for practicing this invention because there was no peel strength with even the EVA-VLDPE blend patches, yet the presumably EVA outer surface of TUF SEAL 90 demonstrated at least equivalent peel strengths to the PERFLEX EVA-VLDPE blend bag outer surface for 100% EVA and EVA-VLDPE blend patches. This anomaly is not understood, but it appears that certain EVA bag outer surfaces are suitable for practicing this invention.

As previously indicated, the practioner will recognize that other bag outer surface properties need to be considered in the selection, as for example puncture strength, and from this standpoint an EVA bag outer surface is inferior to an EVA blend with VLDPE or LLDPE. It is well known to those skilled in the art that VLDPE and LLDPE films have higher puncture strength than EVA film.

Finally, Table E shows that the EVA-LLDPE blend outer surface of TUF SEAL II bags have somewhat lower corona lamination strengths than PERFLEX EVA/VLDPE or TUF SEAL 90 bags. However, these levels are considered adequate for structural integrity of the composite during the processing steps up to the shrink tunnel, so the EVA-LLDPE blend represents an embodiment of the bag outer layer aspect of the invention.

From the puncture strength standpoint, it is known by those skilled in the art that polyethylenes increase in puncture strength with increasing number of carbon atoms in the comonomer. For example, an octene VLDPE has higher puncture strength than butene VLDPE. LLDPE is superior to the EVA and inferior to VLDPE.

Another consideration for the practioner is selecting a suitable bag composition for practicing this invention is the bag heat shrink. From this standpoint EVA is superior to both VLDPE and LLDPE. However, under equivalent conditions VLDPE provides substantially higher heat shrink than LLDPE, and the same is true for EVA-VLDPE blends compared to EVA-LLDPE. These relationships are quantitatively demonstrated in Lustig et al., U.S. Pat. No. 4,863,769, incorporated herein by reference. For these reasons EVA-VLDPE blends are preferred to EVA-LLDPE blends as the bag outer surface.

EXAMPLE 10

The purpose of these experiments was to qualitatively compare the abrasion resistance of certain ethylene copolymer and blends thereof in a screening test which is simpler than the aforedescribed food product package shaker and shipping tests, but which can correlated to these tests through a common control sample. The same eight compositions were used as in the Example 9 corona lamination tests, and the experiments involved measuring loss of material during a standard abrasion treatment, hereinafter referred to as the "Taber Abrasion Test". The apparatus used to perform these tests was a "Taber Abraser" Ser. No. 41187 manufactured by Taber Instrument Corporation, North Tonawanda, N.Y. The apparatus included a power-driven rotatable (70 rpm) flat surface on which the specimen was mounted, and two overhead arms with freely rotatable wheels (about ½ inch wide) mounted on the arm lower ends. A one kgm. weight was attached to each arm. The wheel outer surfaces were coated with abrasive material (in this instance Taber's type CS-17).

The experimental procedure was to cut 4½ inch by 4½ inch samples (four for each composition), mount the sample on a cardboard backing, weigh and secure the mounted sample to the apparatus rotatable flat surface. The latter was rotated 500 cycles and specimen material was removed from the outer surface by abrasive contact with the rotating wheels. The abraded mounted sample was reweighed. Lower weight loss values (measured in mg.) generally indicate better abrasion resistance. The results of these tests are summarized in Table F.

TABLE F

| Composition | Taber Abrasion Test: Weight Loss Due to Abrasion[1] |
|---|---|
| 100% EVA | 67 |

TABLE F-continued

| Composition | Taber Abrasion Test Weight Loss Due to Abrasion[1] |
|---|---|
| 75% EVA - 25% VLDPE | 85 |
| 50% EVA - 50% VLDPE (control) | 53 |
| 25% EVA - 75% VLDPE | 33 |
| 100% LLDPE | 42 |
| 50% EVA - 50% LLDPE | 37 |
| 50% EVA - 50% PLASTOMER | 13 |
| 50% EVA - 50% HDPE | 36 |

[1]Measured in milligrams

It will be noted from Table F that the 50% EVA-50% VLDPE film sample was the control. This is because the previously described shaker tests such as Example 8 and the subsequently described second series of commercial packaging-shipment tests in Example 13 demonstrate that this blend is suitable from the abrasion standpoint as patch material. With this background, Table F demonstrates that from the abrasion standpoint 100% EVA would be inferior to the control as a patch outer surface, whereas 25% EVA-75% VLDPE would be superior. The same is true from the standpoint of selecting a bag outer surface. Although corona lamination Example 12 (Table E) demonstrates that the remaining Table G compositions are not suitable patch materials. However, Table F shows that 50% EVA-50% LLDPE is suitable as a bag outer surface material from the abrasion standpoint. That is, its weight loss was actually less than the 50% EVA-50% VLDPE control material. This data, coupled with the Table E TUF SEAL II bag test on corona lamination strengths, demonstrates the suitability of EVA-LLDPE blends as the bag outer surface in the patch bag article of this invention.

EXAMPLE 11

The purpose of this experiment was to demonstrate the heat shrinking dimensional effects of the bonded non-heat shrinkable patch on the heat shrinkable bag portion bonded to the patch.

The patch bags used in this experiment were identical to those described on Sample 14 in Example 8, and the experimental procedure was identical to that disclosed in ASTM D-2732-83 except that the samples were immersed in the 90° C. bath for 5 seconds, and thereafter air dried. Four specimens were used for each condition, and the results are arithmetically averaged and summarized in Table G.

TABLE G

| Article | Dimensional Effects of Non-Heat Shrinkable Patch: Heat Shrinkability at 90° C. (%) MD | TD |
|---|---|---|
| Patch (before bonding to bag) | 0.9 | 1 |
| Patch (removed from heat shrunk bag) | 4 | 0 |
| Bag (without patch) | 24 | 35 |
| Bag (portion bonded to patch) | 12 | 13 |

It will be noted that after removal from the heat shrunk bag, the patch had more MD shrink (4% vs. 0.9%) although not at the heat shrinkable level). This is believed due to annealing and stretching which occurs during the corona bonding process. The other and a more important observation is that because of its non-heat shrinkable character, the strong bond to the patch substantially restrains and reduces heat shrink in the bag portion bonded to the patch. More particularly, the patch bag MD heat shrinkage is about one-half that of the bag, and the patch bag TD heat shrinkage is only about one-third that of the bag.

EXAMPLE 12

A series of tests were performed under actual commercial packaging and shipping conditions in which different types of patch bags were used to package bone-in meat at a processing plant, the product packages were placed in shipping boxes and shipped a substantial distance by truck to a supermarket distribution center.

In each instance the bone-in meat cuts were NAMP's No. 174 B beef loin, short loin, short-cut. This is the anterior portion of a beef loin, and separated from the sirloin by a straight cut, perpendicular to the to the split surface of the lumbar vertebrae, through a joint immediately anterior to the hip bone, leaving no part of the hip bone and related cartilage in the short loin. The flank was removed by a straight cut from a point on the rib end which is not more than (inch 25 mm) from the outer tip of the loin eye muscle through a point on the sirloin end which is not more than 1 inch (25 mm) from the outer tip of the loin eye muscle.

The food processor placed wax impregnated cloth over and along the length of the chine of each beef short loin for additional protection (the usual practice) and then pulled the patch bag over the wax impregnated cloth-covered bone-in meat. The processing plant evacuated each bag and heat sealed the open end to form a bone-in food containing package with the protruding bones covered by the external patch. The evacuated packages were then passed through a commercial heat shrink tunnel for contact with hot water sprays. The heat shrunk product packages were visually inspected at the processing plant for possible leakage and if the package's vacuum integrity appeared questionable, the bone-in meat was repackaged in another patch bag before shipment. Three of these packages were placed (two on the bottom and one on top) in covered cardboard boxes about 23 inches long×19 inches wide×10 inches high, and stacked in a truck for direct highway shipment to the supermarket distribution center. The shipping arrangement in the truck was to stack the loaded boxes five deep with very little space between the truck side walls and the box side walls, so there was little, if any, sliding of the boxes during transport. At the supermarket distribution center destination, each package was visually inspected to determine if leakage had occurred.

In the first series of tests, 1×1 beef short loins were packaged in 17 inches wide×30 inches long (flat condition) patch bags (one loin per bag) at Garden City, Kans. and shipped to Tempe, Ariz. Two types of prior art patch bags were used along with patch bags of this invention. One prior art bag was the previously described E-Z GUARD Bag and the other type was W. R. Grace Company—Cryovac Division's Model BH620TBG BONE GUARD® patch bag which is used commercially. The latter and its manufacturer are described in Ferguson U.S. Pat. No. 4,755,403, and the patch comprises a two layer tubular heat shrinkable film collapsed on itself with the inner layers formed of self-adhering material to provide a three layer construction. According to the '403 Patent these inner layers are EVA preferably having 28 wt. % vinyl acetate, and the outer layers comprise 87% LLDPE, 10% EVA having 9 wt. % vinyl acetate, and 3% pigments and additives to aid extrusion. The '403 Patent discloses that this heat shrinkable patch was irradiated to about 7 MR and bonded by an adhesive to the outer surface of a bag formed of multilayer heat shrinkable film including a vinylidene chloride copolymer type core barrier layer. The outer layer of this bag appears to be 100% EVA. The Cryovac bag was about 2.3 mils thick and the patch was about 5 mils thick. Since the small dimensions of the product packages were about the same as the unpackaged beef short loins the packages were able to slide in the carton and abrade against each other as well as against the carton walls.

The patch bag embodiment of this invention used in this test series was identical to sample 14 described in Example 8, including a 5 mil thick non-heat shrinkable blown film patch comprising a blend of 50 wt. % VLDPE (0.9 MI) and 50 wt. % EVA (0.9 MI), solely adhered to the bag outer surface by high surface energy from corona treatment.

The results of this first series of commercial packaging and shipping tests are summarized in Table H.

TABLE H

Packaging and Shipping Test - First Series

| At Packaging Site-Type Patch Bag | No. Bags | No. Leakers | % Leakers | Boxes Packed | Leaker Cause |
|---|---|---|---|---|---|
| E-Z GUARD | 75 | 3 | 4 | 24 | 3 bone puncture |
| BONE GUARD | 71 | 2 | 2.8 | 23 | 1 bone puncture; 1 product in seal |
| Invention | 25 | 3 | 12 | 7 | 3 burn-through at heat seal |

| Post Transit Destination - Type Patch Bag | No. Bags | No. Leakers* | % Leakers | Boxes Packed |
|---|---|---|---|---|
| E-Z GUARD | 72 | 18 | 25 | 24 |
| BONE GUARD | 69 | 12 | 17.4 | 23 |
| Invention | 21 | 7 | 33.3 | 7 |

*Since all packages had vacuum integrity when shipped and it was not possible to closely examine each bag, all post-transit leakers were assumed to be bone punctures.

EXAMPLE 13

In the second series of commercial packaging-shipment tests, the inventive patch bags were compared with the aforedescribed commercially employed Cryovac BONE-GUARD heat shrinkable patch type of patch bag, both 17 inches wide×30 long in the flat condition. The invention embodiment used in this second series was identical to that used in the first test series except that the EVA and VLDPE used as the blend for the blown film patch were each the 2.2 melt index types (instead of the 0.9 MI types used in the first test series) as also used in sample 14 of Example 8.

One type "1×1" beef short loin piece was packaged in each patch bag at Greeley, Colorado and shipped by truck to a supermarket distribution center in Bellview, Wash. The chine section of each bone-in meat piece was covered by wax impregnated cloth, consistent with food processors' practice, and the bag was pulled over the cloth covered bone-in meat mass.

After evacuation, heat sealing the bag open end, and heat shrinking the patch bags in a conventional tunnel by contact with hot water spray, the product packages (of about the same size as the first test series product packages) were placed two on the bottom and one on top in a covered cardboard box of about the same size as used in the first test series (three packages per box). Accordingly, the product packages were able to slide in the boxes during transit and abrade against each other and the box walls. The boxes were loaded in a truck for direct highway shipment to the supermarket distribution center. As in the first test, the loaded boxes were stacked five deep in the truck.

As in the first test series, the product packages were visually examined by the food processor at the processing plant to insure vacuum packaging integrity and if questionable, they were repackaged before shipment. Facilities for determining rebag causes were not available, but edge tears were not evident on any of the packages. The packages were visually inspected at destination and the reason for leakage identified if readily apparent. The results of this second series commercial packaging and shipping tests are summarized in Table I.

TABLE I

Packaging and Shipping Test - Second Series

| At Packaging Site-Type Bag | No. Bags | No. Leakers | % Leakers |
|---|---|---|---|
| BONE-GUARD | 100 | 0 | 0.0 |
| Invention | 96 | 1 | 1.0 |

| Post Transit Destination - Type Patch Bag | No. Bags | No. Leakers | % Leakers |
|---|---|---|---|
| BONE-GUARD | 100 | 7 | 7.0 |
| Invention | 57 | 3 | 5.3 |

Inspection of Tables H and I indicates that in the commercial packaging and shipment tests, the patch bag of this invention performed as well as the prior art and commercially successful heat shrinkable patch type patch bags. Comparing Tables H and I, it appears that on a relative basis, the high melt index (MI 2.2) EVA-VLDPE patch embodiment was slightly superior to the low melt index embodiment of the invention. This is consistent with the abrasion resistance tests (e.g. sample 8) and additionally substantiates the preferred patch blend of at least 2 melt index VLDPE and at least 2 melt index EVA.

EXAMPLE 14

The purpose of this experiment was to compare the abrasion resistance of a prior art heat shrinkable patch-bag article and a non heat shrinkable patch-bag article of this invention wherein the bag thickness of the two articles is the same. It will be recalled that in Examples 5 and 8 wherein patch-bag articles of this invention were compared with the commercially employed heat shrinkable E-Z GUARD patch bags, the former were 3.25 mil thick bags whereas the latter were 2.25 mil thick. Also, in the Examples 12 and 13 packaging-shipping tests, the commercially employed heat shrinkable BONE GUARD patch bags had 2.3 mil thick bags. However, in these tests all patches were about 5 mils thick, although those of this invention were non-heat shrinkable so did not change in thickness when the bag was shrunk and the commercially employed heat shrinkable patches slightly increased in thickness to about 5½ mils when shrunk.

In the first test series wherein twenty four bags were used of each type, the shaker table abrasion resistance of 2.25 mil thick bags (sample 16) were compared with the previously described 3.25 mil thick bags of this invention (sample 17), both with 5 mil thick patches. The control was the aforedescribed Cryovac BONE-GUARD heat shrinkable patch bag wherein the bag was about 2.3 mil thick (sample 18).

In the second test series wherein twelve bags were used of each type, the shaker table abrasion resistance of 2.25 mil thick bags—7 mil patch irradiated at 10 MR (sample 19) and 2.25 mil thick bag - 5 mil thick patch irradiated at 4 MR (sample 20) were compared with the aforedescribed Cryovac BONE-GUARD heat shrinkable irradiated patch bag having similar bag and patch thickness (sample 21). Also included in this test series was a 2.75 mil thick bag—5 mil patch irradiated at 10 MR (sample 22). Second test series samples 19, 20 and 22 are embodiments of the invention.

In these tests, the sample 16, 17, 19, 20 and 22 patches were the same 50% EVA (Exxon's type LD318.92, MI 2.2)—50% VLDPE (Exxon's type 3010B, M 2.2) blown film described in Example 8. The sample 16, 17, 19, 20 and 22 bags were the aforedescribed three layer PERFLEX type wherein the outer layer comprised 75% VLDPE—25% EVA. In samples 16, 19 and 20 this layer was 0.6 mil thick, in sample 17 it was 0.9 mil thick and in sample 22 it was 0.7 mil thick.

The test bags, were loaded with No. 107 beef ribs, evacuated, sealed and immersed in hot water, then subjected to abrasion testing on the previously described shaker table, following the same procedure as the tests summarized in Table D. The results of these tests are summarized in Table J.

gested that based on the teachings of Ferguson U.S. Pat. No. 4,755,403 the control sample heat shrinkable patches of samples 18 and 21 were probably irradiated at about 7 MR.

EXAMPLE 15

The purpose of this experiment was to compare the abrasion resistance of a prior art heat shrinkable patch-bag article and a non heat shrinkable patch-bag article of this invention wherein the bag thickness of the two articles is the same. It will be recalled that in Examples 5 and 8 wherein patch-bag articles of this invention were compared with the commercially employed heat shrinkable E-Z GUARD patch bags, all of the patches used in these experiments were irradiated to about 10 MR dosage. Also, in the Example 12 and 13 packaging—shipping tests, it appears that the commercially employed heat shrinkable BONE-GUARD bags employed patches which were irradiated at about 7 MR dosage.

Three test series were run and each included invention embodiment patch bags with nonirradiated 5 mil thick patches, and BONE-GUARD bags with irradiated 5 mil thick patches as control. In the first series, all invention embodiments employed 3.25 mil thick heat shrinkable bags; the sample 23 patch was irradiated at 10 MR, the sample 24 patch was identical to sample 23 except that it included 2,000 ppm $SiO_2$ antiblocking agent, and the sample 25 patch was identical to sample 24 except the patch was not irradiated.

The second series was essentially a repetition of the first series with all invention embodiments employing 3.25 mil thick heat shrinkable bags. Sample 27 patch was irradiated at 10 MR, sample 28 patch was identical to sample 27 except that it included 2,000 ppm $SiO_2$ antiblocking agent, and the sample 29 patch was identical to sample 28 except the patch was not irradiated.

TABLE J

| | | Shaker Abrasion Tests - Same Bag Thickness | | | | | | | | | | | |
|---|---|---|---|---|---|---|---|---|---|---|---|---|---|
| | | | Pkg. Failure Distribution | | | | | | Pkg. | Survival Time | | | |
| Sample No. (b) | Type (a) | No. Bags Tested | 15 | 30 | 45 | 60 | 90 | 105 | Survival 120 | Ave. (min) | S.D. (min) | Act. Total (min) | % max |
| | | | (minutes) | | | | | | | | | | |
| 16 | 2.25 mil bag, 5 mil patch | 24 | 17 | 4 | 2 | 1 | | | 0 | 22 | 12 | 525 | 16 |
| 17 | 3.25 mil bag, 5 mil patch | 24 | 13 | 2 | 3 | 4 | 1 | 1 | 0 | 34 | 26 | 825 | 25 |
| 18 | control (a) | 24 | 17 | 4 | 1 | | 1 | | 1 | 27 | 28 | 645 | 20 |
| 19 | 2.25 mil bag, 7 mil patch (d) | 12 | 4 | 5 | 1 | 1 | | | 1 | 36 | 30 | 435 | 27 |
| 20 | 2.25 mil bag, 5 mil patch (d) | 12 | 10 | 2 | | | | | 0 | 18 | 6 | 210 | 13 |
| 21 | control (a) | 12 | 9 | 3 | | | | | 0 | 19 | 7 | 225 | 14 |
| 22 | 2.75 mil bag, 5 mil patch (d) | 12 | 9 | 2 | | | | 1 | 0 | 25 | 26 | 300 | 19 |

(a) All control bags were Cryovac BONE-GUARD.
(b) Samples 16, 17, 19, 20 and 22 are invention embodiments.
(c) All invention embodiment patches were irradiated at 10 MR except for sample 20 which was irradiated at 4 MR.
(d) Patch contained 1% color concentrate and 2000 ppm. $SiO_2$ as antiblock.

Table J shows that in the first test series the abrasion resistance of the 2.25 mil bag invention embodiment sample 16 was similar to the prior art 2.3 mil bag of the competitor's commercially used patch bag sample 18 (control). In the second test series the abrasion resistance of the 2.25 mil bag invention embodiment sample 20 was about the same as the prior art control patch bag sample 21 having the same bag thickness. It is concluded from the foregoing that even based on the same bag thickness, the patch bag of this invention has similar abrasion resistance to the commonly employed patch bag in the food packaging industry.

Comparing invention embodiment samples 19 and 20, it appears that abrasion resistance may be improved by increasing the thickness of the patch although it should be noted that the thinner 5 mil patch of sample 20 was irradiated at only 4 MR. It has previously been sug- In the third test series both invention embodiments employed 2.25 mil thick bags; sample 31 patch was irradiated at 10 MR whereas the sample 32 patch was not irradiated.

The test procedure was the same as in the previously described shaker table examples, and the invention embodiment bags were the aforedescribed three layer PERFLEX type wherein the outer layer comprised 75% VLDPE—25% EVA as detailed in Example 8. The invention embodiment patches were the same 50% EVA—50% VLDPE type also described in Example 8.

The test bags were loaded with No. 107 beef ribs and processed in the same manner as the examples summarized in Table D. The shaker table test results are summarized in Table K.

TABLE K

Shaker Abrasion Tests - Non Irradiated Patch

| Sample No. (b) | Type (c) | No. Bags Tested | Pkg. Failure Distribution 15 | 30 | 45 | 60 | 75 | 90 | 105 | 120 (minutes) | Pkg. Surv. 120 | Survival Time Ave. (min) | S.D. (min) | Act. Total (min) | % max |
|---|---|---|---|---|---|---|---|---|---|---|---|---|---|---|---|
| 23 | 3.25 mil bag, 10 MR patch | 12 | 5 | 2 | 2 | | | | | | 3 | 52 | 51 | 630 | 39 |
| 24 | 3.25 mil bag, 10 MR patch (d) | 12 | 8 | 1 | 1 | | 2 | | | | 0 | 32 | 29 | 375 | 23 |
| 25 | 3.25 mil bag, no irr. patch (d) | 12 | 8 | 1 | | | | | 1 | 1 | 1 | 42 | 47 | 510 | 31 |
| 26 | control (a) | 12 | 8 | 1 | 1 | 2 | | | 1 | | 0 | 26 | 18 | 315 | 19 |
| 27 | 3.25 mil bag, 10 MR patch | 12 | 5 | | 4 | 2 | | | | | 0 | 34 | 18 | 405 | 25 |
| 28 | 3.25 mil bag, 10 MR patch (d) | 12 | 5 | | 1 | 1 | 1 | | | 1 | 3 | 57 | 48 | 690 | 43 |
| 29 | 3.25 mil bag, no irr. patch (d) | 12 | 6 | 1 | 2 | 1 | | 1 | 1 | | 0 | 39 | 32 | 465 | 29 |
| 30 | control (a) | 12 | 7 | 1 | 1 | 1 | 1 | | | | 1 | 37 | 37 | 450 | 28 |
| 31 | 2.25 mil bag, 10 MR patch | 12 | 9 | 1 | | 1 | 1 | | | | 0 | 25 | 21 | 300 | 19 |
| 32 | 2.25 mil bag, no irr. patch | 12 | 7 | 4 | | | | 1 | | | 0 | 26 | 21 | 315 | 19 |
| 33 | control (a) | 12 | 8 | 1 | 1 | 2 | | | | | 0 | 26 | 18 | 315 | 19 |

(a) All control bags were Cryovac BONE-GUARD.
(b) Samples 16, 17, 19, 20 and 22 are invention embodiments.
(c) All invention embodiment patches were irradiated at 10 MR except for sample 20 which was irradiated at 4 MR.
(d) Patch contained 1% color concentrate and 2000 ppm. $SiO_2$ as antiblock.

Table K shows that with respect to the first test series 3.25 mil thick patch bags with 2000 ppm $SiO_2$ antiblock in the patch, the abrasion resistance of the nonirradiated patch sample 25 was at least equivalent to the 10 MR irradiated patch sample 24. The 10 MR irradiated patch sample 23 without $SiO_2$ antiblock had the best abrasion resistance of the first series. All invention embodiments were superior to the commercial patch bag control sample 26. In the second test series, 2000 ppm $SiO_2$10 MR irradiated patch sample 28 provided the best abrasion resistance, but the 2000 ppm $SiO_2$ nonirradiated patch sample 29 was equivalent to the commercial patch bag control sample 30.

In the third test series, the 2.25 mil thick bag with a nonirradiated patch sample 32 performed as well as the 10 MR irradiated patch sample 31 and the commercial patch bag control sample 33.

An overall conclusion from the Example 15 tests is that from the abrasion resistance standpoint, the patch bag of tho present invention does not require irradiation of the non-heat shrinkable patch. Its performance is functionally equivalent to the commercially employed patch bags using a irradiated heat shrinkable patch. This means that substantial economies may be realized by eliminating the costly and time-consuming steps of biaxially orienting and irradiating the patch. However, for some end uses it may be desirable to irradiate the blown film patch for superior abrasion resistance or puncture strength.

The Example 15 third test series also confirms the results of the Example 14 tests by showing that with the same thickness bag, the abrasion resistance of the present patch bag is at least equivalent to commercially employed patch bags.

Further modifications of the invention will be apparent to those skilled in the art and all such modifications are deemed to be within the scope of the invention as defined in the following claims.

What is claimed is:

1. An article for enclosing bone-in food mass comprising a biaxially oriented heat shrinkable relatively thin-walled thermoplastic film bag and a non-heat shrinkable relatively thick-walled thermoplastic film patch having its inner surface bonded to outer surface of said bag, the patch outer surface comprising a member selected from the group consisting of ethylene vinyl acetate, very low density polyethylene and linear low density polyethylene, or blends thereof; the patch inner surface comprising a member selected from the group consisting of ethylene vinyl acetate, very low density polyethylene, and blends of ethylene vinyl acetate and very low density polyethylene; and the bag outer surface comprising a member selected from the group consisting of ethylene vinyl acetate, very low density polyethylene, blends of ethylene vinyl acetate and very low density polyethylene, blends of ethylene vinyl acetate and linear low density polyethylene, and blends of ethylene vinyl acetate, very low density polyethylene and linear low density polyethylene; and said patch inner surface and said bag outer surface each having high surface energy of at least about 38 dynes/cm wetting tension as the sole bonding means therebetween such that when said bag is filled with bone-in food mass, evacuated, sealed and heat shrunk around said mass, the strength of the patch-bag bond increases and the bag portion adhered to said patch shrinks to a lesser extent than the remainder of said bag, but said patch does not delaminate from said bag.

2. An article according to claim 1 wherein the ethylene vinyl acetate in said patch inner surface and said bag outer surface has about 8–12% vinyl acetate content by weight.

3. An article according to claim 1 wherein said patch inner surface and said bag outer surface each contain ethylene vinyl acetate and the ethylene vinyl acetate contents in said patch inner surface and said bag outer surface are within about 25 weight % of each other.

4. An article according to claim 1 wherein said patch inner surface and said bag outer surface each contain very low density polyethylene, and the very low density polyethylene contents in said patch inner surface and said bag outer surface are within about 25 weight % of each other.

5. An article according to claim 1 wherein patch inner surface and said bag outer surface each comprise a blend of ethylene vinyl acetate and very low density polyethylene.

6. An article according to claim 1 wherein said patch inner surface and said bag outer surface each comprise a blend of about 15–65% ethylene vinyl acetate and about 85–35% very low density polyethylene.

7. An article according to claim 1 wherein said high surface energy is imparted to said patch inner surface and said bag outer surface by corona treatment.

8. An article according to claim 7 wherein said high surface energy imparted to said patch inner surface and said bag outer surface is about 44–46 dynes/cm wetting tension.

9. An article according to claim 1 wherein said patch has identical inner and outer surfaces, and is a monolayer film.

10. An article according to claim 1 wherein said patch is a monolayer film comprising a blend of ethylene vinyl acetate and very low density polyethylene.

11. An article according to claim 1 wherein said bag comprises at least three layers including an oxygen barrier core layer with inner and outer layers adhered to opposite sides of said core layer, and said outer layer comprises a blend of ethylene vinyl acetate and very low density polyethylene or linear low density polyethylene.

12. An article according to claim 1 wherein said patch is a multilayer film.

13. An article according to claim 1 wherein the high surface energy patch inner surface and bag outer surface are contacted under heat.

14. An article according to claim 1 wherein the bonding high surface energy patch inner and bag outer surface are contacted under pressure of about 45–100 psi. and heat.

15. An article according to claim 1 wherein the patch is irradiated.

16. An article according to claim 15 wherein the patch is irradiated at dosage of at least about 5 MR.

17. An article according to claim 1 wherein said patch is a monolayer film comprising between about 25-50% ethylene vinyl acetate and about 75–50% very low density polyethylene.

18. An article according to claim 6 wherein said bag portion bonded to said non-heat shrinkable patch has unrestrained shrinkage below about 2% at 90° C. in each of the transverse and machine directions.

19. A food package comprising a heat shrunk and relatively thin-walled thermoplastic film bag with an outer surface comprising a member selected from the group consisting of ethylene vinyl acetate, very low density polyethylene, blends of ethylene vinyl acetate and very low density polyethylene, blends of ethylene vinyl acetate and linear low density polyethylene, and blends of ethylene vinyl acetate, very low density polyethylene and linear low density polyethylene; said bag containing bone-in food mass in an evacuated and sealed space within the bag such that the bone-in food mass outer surface is in direct supporting relationship with the collapsed bag inside surface; a non heat shrinkable and relatively thick-walled, thermoplastic film patch having an outer surface comprising a member selected from the group consisting of ethylene vinyl acetate, very low density polyethylene and linear low density polyethylene, or blends thereof; the patch inner surface comprising a member selected from the group consisting of ethylene vinyl acetate, very low density polyethylene, and blends of ethylene vinyl acetate and very low density polyethylene; and said patch inner surface and the heat shrunk bag outer surface being bonded together solely by each of said surfaces having high surface energy of at least about 38 dynes/cm wetting tension such that when said bag is heat shrunk the strength of the patch-bag bond increases and the bag portion adhered to said patch shrinks to a lesser extent than the nonpatched remainder of said bag, but said patch does not delaminate from said bag.

* * * * *